US008752656B2

(12) United States Patent
Zhang et al.

(10) Patent No.: US 8,752,656 B2
(45) Date of Patent: Jun. 17, 2014

(54) METHOD OF DESIGNING A BOTTOM HOLE ASSEMBLY AND A BOTTOM HOLE ASSEMBLY

(75) Inventors: Youhe Zhang, Spring, TX (US); Yuelin Shen, Spring, TX (US); Madapusi K Keshavan, The Woodlands, TX (US); Peter T Cariveau, Draper, UT (US)

(73) Assignee: Smith International, Inc., Houston, TX (US)

( * ) Notice: Subject to any disclaimer, the term of this patent is extended or adjusted under 35 U.S.C. 154(b) by 414 days.

(21) Appl. No.: 12/640,227

(22) Filed: Dec. 17, 2009

(65) Prior Publication Data

US 2010/0155149 A1 Jun. 24, 2010

Related U.S. Application Data

(60) Provisional application No. 61/138,810, filed on Dec. 18, 2008, provisional application No. 61/143,875, filed on Jan. 12, 2009.

(51) Int. Cl.
*E21B 10/36* (2006.01)

(52) U.S. Cl.
CPC ..... *E21B 10/36* (2013.01)
USPC ..... 175/434; 175/433

(58) Field of Classification Search
USPC ..... 175/428, 420.2, 433, 434; 76/108.4
See application file for complete search history.

(56) References Cited

U.S. PATENT DOCUMENTS

| | | | |
|---|---|---|---|
| 4,664,705 | A | 5/1987 | Horton |
| 4,815,342 | A | 3/1989 | Brett et al. |
| 5,010,789 | A | 4/1991 | Brett et al. |
| 5,042,596 | A | 8/1991 | Brett et al. |
| 5,127,923 | A | 7/1992 | Bunting et al. |
| 5,131,479 | A | 7/1992 | Boulet et al. |
| 5,607,024 | A | 3/1997 | Keith et al. |
| 5,787,022 | A | 7/1998 | Tibbitts et al. |
| 5,950,747 | A | 9/1999 | Tibbitts et al. |
| 6,021,859 | A | 2/2000 | Tibbitts et al. |
| 6,287,360 | B1 | 9/2001 | Kembaiyan et al. |

(Continued)

FOREIGN PATENT DOCUMENTS

KR 100865271 B1 10/2008

OTHER PUBLICATIONS

International Search Report and Written Opinion dated Jul. 8, 2010 for corresponding PCT application No. PCT/US2009/068398 filed Dec. 17, 2009.

(Continued)

*Primary Examiner* — Cathleen Hutchins

(57) ABSTRACT

A bottom hole assembly containing a drill bit. The drill bit additionally has a plurality of primary cutter elements mounted thereto. The plurality of cutter elements comprise one or more first cutter elements and one or more second cutter elements. The second cutter element differs from the first cutter element in at least one cutter element property. The first cutter element has a diamond body containing a first region comprising an infiltrant material disposed within the interstitial regions. The first region is located remote from the working surface of the diamond body. The first cutter element also contains a second region comprising interstitial regions that are substantially free of the infiltrant material. The second region is located along at least the working surface of the diamond body. Also included are a cutter element, method of designing a bottom hole assembly as well as method of designing a drill bit.

30 Claims, 11 Drawing Sheets

(56) References Cited

U.S. PATENT DOCUMENTS

| | | | | |
|---|---|---|---|---|
| 6,424,919 | B1 | 7/2002 | Moran et al. | |
| 6,435,058 | B1 | 8/2002 | Matthias et al. | |
| 6,481,511 | B2 | 11/2002 | Matthias et al. | |
| 6,516,293 | B1 | 2/2003 | Huang et al. | |
| 6,785,641 | B1 | 8/2004 | Huang | |
| 7,020,597 | B2 | 3/2006 | Oliver et al. | |
| 7,139,689 | B2 | 11/2006 | Huang | |
| 7,251,590 | B2 | 7/2007 | Huang et al. | |
| 7,260,514 | B2 | 8/2007 | Huang | |
| 7,441,612 | B2 | 10/2008 | Durairajan et al. | |
| 7,464,013 | B2 | 12/2008 | Huang et al. | |
| 2002/0166703 | A1 | 11/2002 | Presley | |
| 2004/0254664 | A1 | 12/2004 | Centala et al. | |
| 2005/0015229 | A1 | 1/2005 | Huang | |
| 2005/0080595 | A1 | 4/2005 | Huang | |
| 2005/0096847 | A1 | 5/2005 | Huang | |
| 2005/0133272 | A1 | 6/2005 | Huang et al. | |
| 2005/0263328 | A1* | 12/2005 | Middlemiss | 175/434 |
| 2005/0273301 | A1 | 12/2005 | Huang | |
| 2005/0273304 | A1 | 12/2005 | Oliver et al. | |
| 2006/0149518 | A1 | 7/2006 | Oliver et al. | |
| 2006/0167668 | A1 | 7/2006 | Cariveau et al. | |
| 2006/0167669 | A1 | 7/2006 | Cariveau et al. | |
| 2006/0207802 | A1 | 9/2006 | Zhang et al. | |
| 2006/0254829 | A1 | 11/2006 | Cariveau | |
| 2007/0005316 | A1 | 1/2007 | Paez | |
| 2007/0021857 | A1 | 1/2007 | Huang | |
| 2007/0067147 | A1 | 3/2007 | Huang | |
| 2007/0079994 | A1* | 4/2007 | Middlemiss | 175/426 |
| 2007/0079995 | A1* | 4/2007 | McClain et al. | 175/426 |
| 2007/0093996 | A1 | 4/2007 | Cariveau et al. | |
| 2008/0053709 | A1 | 3/2008 | Lockstedt et al. | |
| 2008/0223621 | A1 | 9/2008 | Middlemiss et al. | |
| 2008/0223623 | A1 | 9/2008 | Keshavan | |
| 2008/0230280 | A1* | 9/2008 | Keshavan et al. | 175/434 |
| 2009/0260893 | A1 | 10/2009 | Sheng et al. | |

OTHER PUBLICATIONS

W02002024603 is being filed as an English language equivalent to KR10-0865271B1.

* cited by examiner

METHOD OF DESIGNING A BOTTOM HOLE ASSEMBLY AND A BOTTOM HOLE ASSEMBLY

CROSS-REFERENCE TO RELATED APPLICATIONS

This application claims priority to U.S. Provisional Application No. 61/138,810, filed Dec. 18, 2008 and U.S. Provisional Application No. 61/143,875, filed Jan. 12, 2009, both of which are incorporated by reference in their entirety.

FIELD OF THE INVENTION

The invention relates to bottom hole assemblies used to form wellbores in earthen formations and more particularly, the arrangement of cutter elements on the bottom hole assembly using two or more different cutter elements.

BACKGROUND OF THE INVENTION

In a conventional drilling system for drilling an earthen formation, the drilling system includes a drilling rig used to turn a drilling tool assembly that extends downward into a wellbore. The drilling tool assembly includes a drill string and a bottom hole assembly (BHA). The drill string includes several joints of drill pipe connected end to end through tool joints. The drill string is used to transmit drilling fluid (through its hollow core) and to transmit rotational power from the drill rig to the BHA. A wide variety of bottom hole assemblies have previously been used to form wellbores in downhole formations. Typically, the bottom hole assembly contains at least a drill bit. Typical BHA's may also include additional components attached between the drill string and the drill bit. Examples of additional BHA components include, but are not limited to, drill collars, stabilizers, measurement-while-drilling (MWD) tools, logging-while-drilling (LWD) tools, subs, hole enlargement devices (e.g., hole openers and reamers), jars, accelerators, thrusters, downhole motors, and rotary steerable systems.

Drilling a borehole for the recovery of hydrocarbons or minerals is typically very expensive due to the high cost of the equipment and personnel that are required to safely and effectively drill to the desired depth and location. The total drilling cost is proportional to the length of time it takes to drill the borehole. The drilling time, in turn, is greatly affected by the rate of penetration (ROP) of the drill bit and the number of times the drill bit must be changed in the course of drilling. A bit may need to be changed because of wear or breakage. Each time the bit is changed, the entire drill string and BHA, which may be may be miles long, must be retrieved from the borehole, section by section. Once the drill string has been retrieved and the new bit installed, the bit must be lowered to the bottom of the borehole on the drill string which must be reconstructed again, section by section. As is thus obvious, this process, known as a "trip" of the drill string, requires considerable time, effort, and expense. Accordingly, because drilling cost is time dependent, it is desirable to employ drill bits that will drill faster and longer and that are useable over a wide range of differing formation hardnesses.

The length of time that a drill bit may be employed before the drill string must be tripped and the bit changed depends upon the bit's rate of penetration (ROP), as well as its durability, that is, its ability to maintain a high or acceptable ROP. Additionally, a desirable characteristic of the bit is that it is stable and resists vibration, the most severe type or mode of which is "whirl." Whirl is a term used to describe the phenomenon where a drill bit rotates at the bottom of the borehole about a rotational axis that is offset from the geometric center of the drill bit. The whirling subjects the cutter elements on the bit to increased load, impact and wear, which can cause premature failure of the cutter elements and a loss of penetration rate. Other forms of vibrational forces include axial, lateral and torsional forces exerted on the drill bit.

A typical drill bit used in a BHA is a fixed cutter rotary drill bit, also referred to as a "drag" bit. Referring to FIG. 1, a fixed cutter rotary drill bit is shown. The drill bit 10 includes a steel bit body 12 (or a matrix bit body), which includes at least one cutter element 40, 50, a shank 13, and a threaded connection or pin 14 for connecting bit 10 to a drill string (not shown). A cutting structure 15 is provided on the bit face 20 of bit 10. Cutting structure 15 includes three angularly spaced-apart primary blades 31, 32, 37 and three secondary blades 33, 34, 35, which extends generally outwardly away from a central longitudinal axis 11 of the drill bit 10. The cutter elements 40, 50 are disposed on the primary blades 31, 32, 37 and secondary blades 33, 34, 35. The blades include cutter pockets 23 which are adapted to receive the cutter elements 40, 50, and the cutter elements 40, 50 are usually brazed into the cutter pockets 23. The blades include gage pads 51 which contact the wall of the bore hole (not shown). The number of blades and/or cutter elements is related, among other factors, to the type of formation to be drilled, and can thus be varied to meet particular drilling requirements.

Another drill bit used in a BHA is a hybrid rotary drill bit, as shown in FIG. 2, which is a diamond impregnated bit 10 with one or more cutter elements 40 placed within a cutter pocket 23 on the one or more diamond impregnated blades 195 or "ribs".

Another drill bit used in a BHA is a bi-centered drill bit, as shown in FIG. 3. A conventional bi-center bit 71 comprises a lower pilot bit section 10 and a longitudinally offset, radially extending reaming section 72. During drilling, the bit rotates about the central axis 11 of the pilot section, causing the reaming section 72 to cut a hole having a diameter equal to twice the greatest radius of the reaming section 72. Cutter elements 40 are located on the bit 10 and cutter elements 70 are located on the reaming section 72.

It is desirable to design a bottom hole assembly comprising a drill bit which optimizes the arrangement of cutting elements to enhance drilling performance and extend the drilling life of the drill bit and BHA.

SUMMARY OF THE INVENTION

In one aspect, the present disclosure relates to a method of designing a bottom hole assembly comprising a drill bit having a bit body and a plurality of cutter elements attached thereto. The method comprises selecting a design; determining at least one or more properties of the drill bit; and determining an arrangement for the plurality of cutter elements to be positioned upon the bit body. One or more areas of the drill bit have different properties (characteristics) relative to other areas of the drill bit. The plurality of cutter elements comprises at least one of a first cutter element and at least one of a second cutter element. The first cutter element is a thermally stable polycrystalline diamond cutter element containing a diamond body having a material microstructure comprising a matrix phase of bonded together diamond crystals formed at high pressure/high temperature conditions in the presence of a catalyst material. The diamond body having a surface and including interstitial regions within the diamond body disposed between the diamond crystals. The interstitial regions within the diamond body are substantially free of the catalyst material. The diamond body further comprises a first region comprising an infiltrant material disposed within the interstitial regions and remote from the (working) surface, and a second region comprising interstitial regions that are substantially free of the infiltrant material. The second cutter element differs from the first cutter element in at least one cutter element property. The at least one first cutter element and the at least one second cutter element are positioned on the surface of the bit body based on the one or more drill bit properties and the one or more cutter element properties. Additionally, the present disclosure also relates to a method of designing a drill bit. The present disclosure also relates to a bottom hole assembly and drill bit designed by such methods.

In another aspect, the present disclosure relates to a drill bit for drilling a borehole in earthen formations. The drill bit comprises a bit body having a bit axis and a bit face including a cone region, a shoulder region, and optionally a gage region. The drill bit further comprises one or more primary blades extending radially along the bit face from the cone region through the shoulder region to the gage region. A plurality of primary cutter elements are mounted to one or more of the primary blades in the shoulder region which comprise a first cutter element and a plurality of primary cutter elements are mounted to one or more of the primary blades in the cone region which comprise a second cutter element. The first cutter element is a thermally stable polycrystalline diamond cutter element containing a diamond body having a material microstructure comprising a matrix phase of bonded together diamond crystals formed at high pressure/high temperature conditions in the presence of a catalyst material. The diamond body having a surface and including interstitial regions within the diamond body disposed between the diamond crystals. The interstitial regions within the diamond body are substantially free of the catalyst material. The diamond body further comprises a first region comprising an infiltrant material disposed within the interstitial regions and remote from the (working) surface, and a second region comprising interstitial regions that are substantially free of the infiltrant material. The second cutter element differs from the first cutter element in at least one cutter element property. In another aspect, the present disclosure relates to cutter elements for use with a bottom hole assembly, in particular a drill bit.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Figure 1:
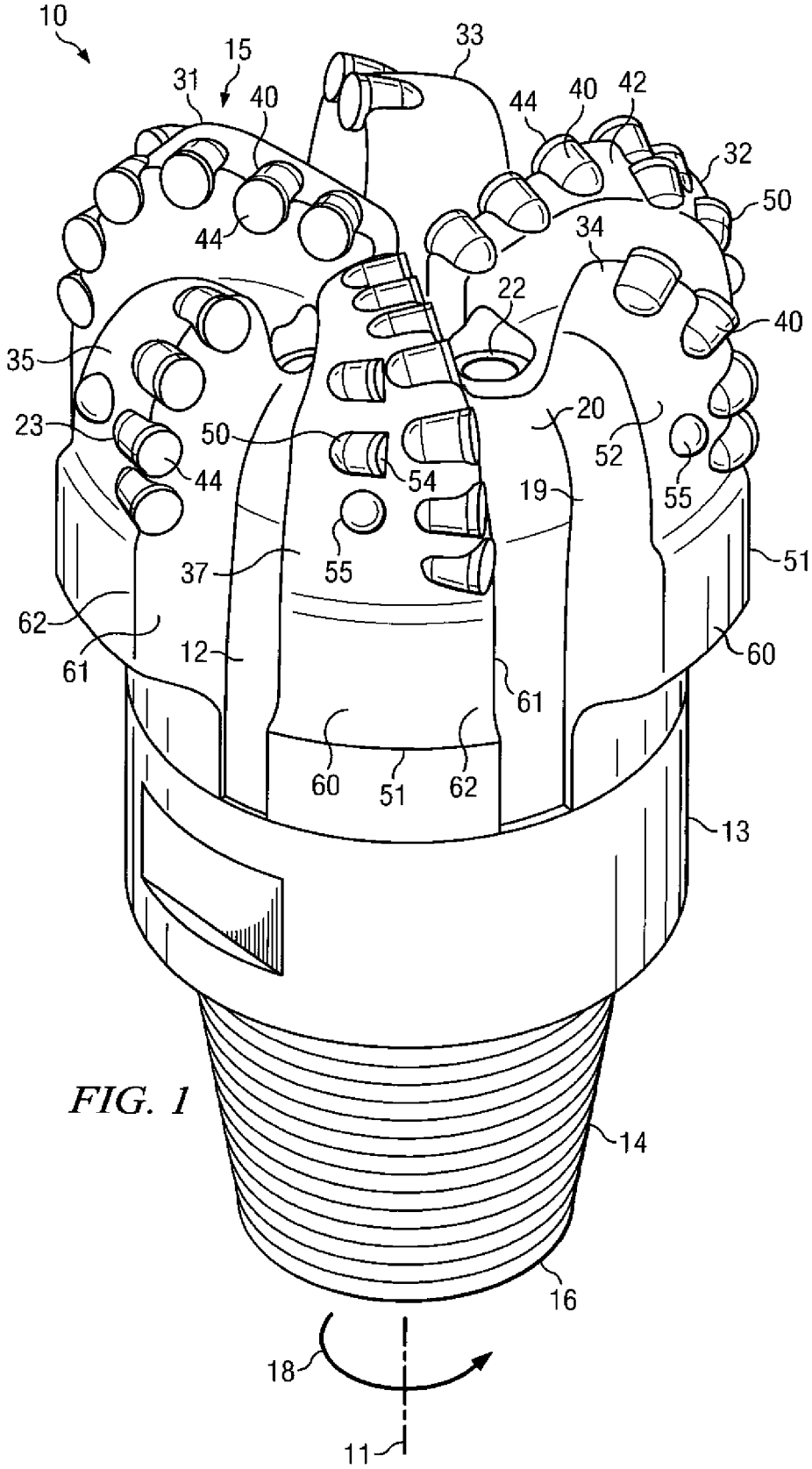
FIG. 1 is an illustration of a fixed cutter rotary drill bit.
Figure 2:
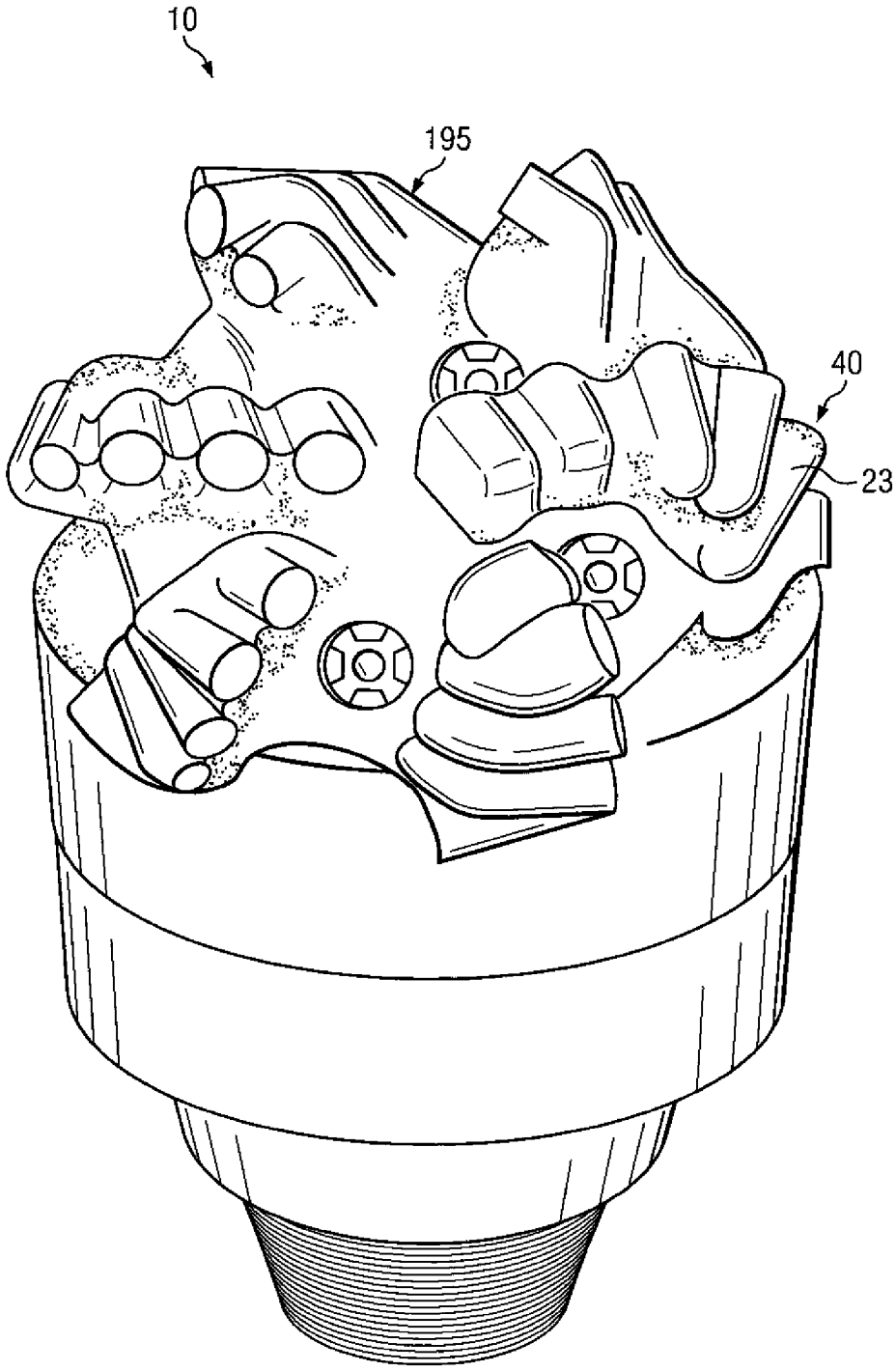
FIG. 2 is an illustration of a hybrid rotary drill bit.
Figure 3:
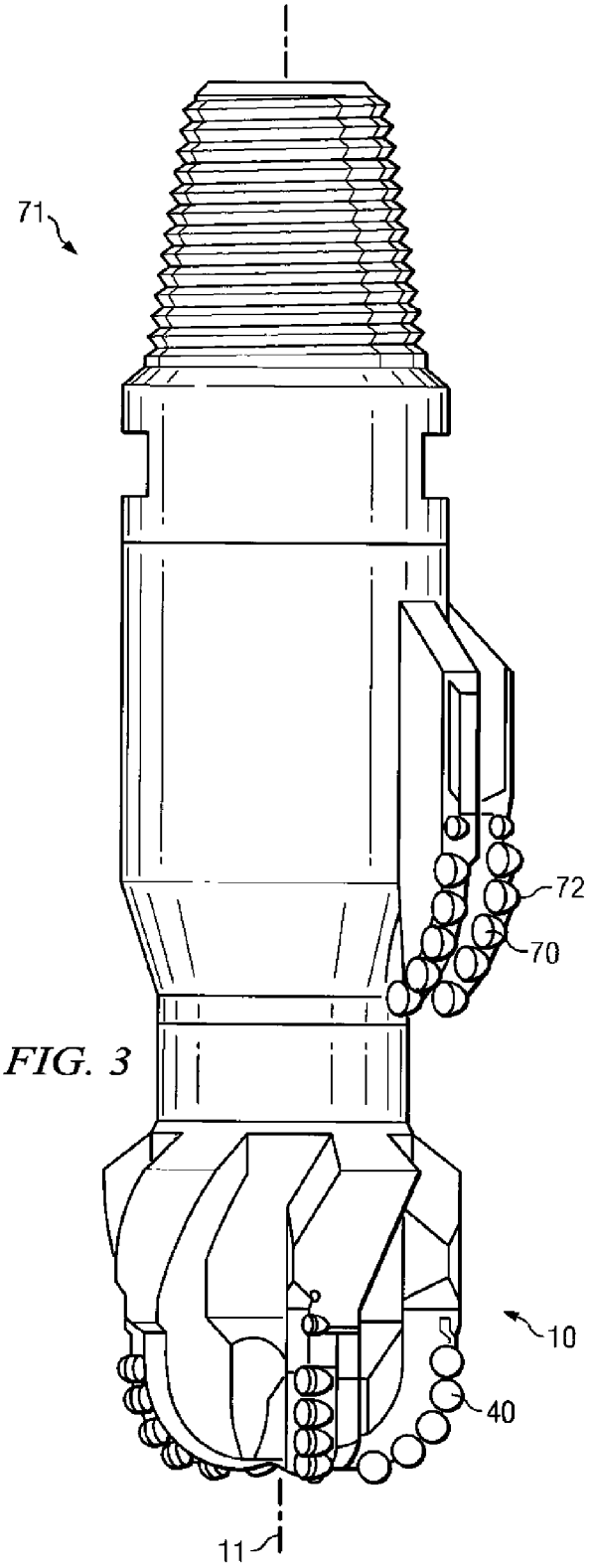
FIG. 3 is an illustration of a bi-centered rotary drill bit.

In one aspect, the present disclosure provides for the design of drill bits and bottom hole assemblies with improved drilling efficiency and downhole drilling life by utilizing at least two different cutter elements and selectively positioning the different cutter elements at optimum locations based on the properties of the BHA and the properties of the cutter elements. Cutter elements may be manufactured in various configurations with a wide range of material properties. Selecting the optimum cutter element for different areas of a drill bit or bottom hole assembly can maximize performance as well as reduce cost.

The following disclosure is directed to various embodiments of the invention. The embodiments disclosed have broad application, and the discussion of any embodiment is meant only to be exemplary of that embodiment, and not intended to intimate that the scope of the disclosure, including the claims, is limited to that embodiment or to the features of that embodiment.

Certain terms are used throughout the following description and claim to refer to particular features or components. As one skilled in the art would appreciate, different persons may refer to the same feature or component by different names. This document does not intend to distinguish between components or features that differ in name only. The drawing figures are not necessarily to scale. Certain features and components herein may be shown exaggerated in scale or in somewhat schematic form and some details of conventional elements may not be shown in the interest of clarity and conciseness.

In the following description and in the claims, the terms "including" and "comprising" are used in an open-ended fashion, and thus, should be interpreted to mean "including, but not limited to . . . . "

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, quantities, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of 1 to 4.5 should be interpreted to include not only the explicitly recited limits of 1 to 4.5, but also include individual numerals such as 2, 3, 4, and sub-ranges such as 1 to 3, 2 to 4, etc. The same principle applies to ranges reciting only one numerical value, such as "at most 4.5", which should be interpreted to include all of the above-recited values and ranges. Further, such an interpretation should apply regardless of the breadth of the range or the characteristic being described.

When using the term "different" in reference to materials used, it is to be understood that this includes materials that generally include the same constituents, but may include different proportions of the constituents and/or that may include differently sized constituents, wherein one or both operate to provide a different mechanical and/or thermal property in the material. The use of the terms "different" or "differ", in general, are not meant to include typical variations in manufacturing.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Figure 4:
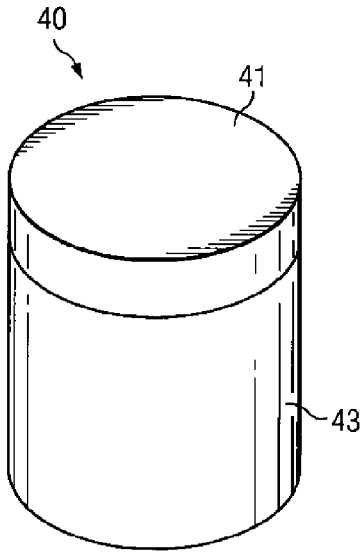
FIG. 4 is a perspective side view of a cutter element comprising a substrate.

In one aspect, embodiments disclosed herein relate to a method of designing a bottom hole assembly. The bottom hole assembly comprises a drill bit. The drill bit may be any drill bit comprising a plurality of cutter elements (shear cutters). For example, the drill bit may be a fixed cutter rotary drill bit, a hybrid rotary drill bit or a bi-centered rotary drill bit, as discussed above. The cutter elements 40 may comprise a substrate 43 and a cutting layer (cutting table) 41, for example a polycrystalline diamond table, as shown in FIG. 4.

A bottom hole assembly design, in particular a drill bit design, may be selected for drilling a selected earthen formation. A determination may be made as to one or more properties (characteristics) of the bottom hole assembly, in particular the drill bit. A determination may be made of an arrangement for the one or more first cutter elements and the one or more second cutter elements based on the one or more properties of the bottom hole assembly, in particular the drill bit. One skilled in the art would appreciate in light of the teachings of the present disclosure that the process may be repeated multiple times to determine the optimal design and cutter element arrangement. A bottom hole assembly designed by such a method may be made by assembling the components contained in the bottom hole assembly according to the design.

Figure 14:
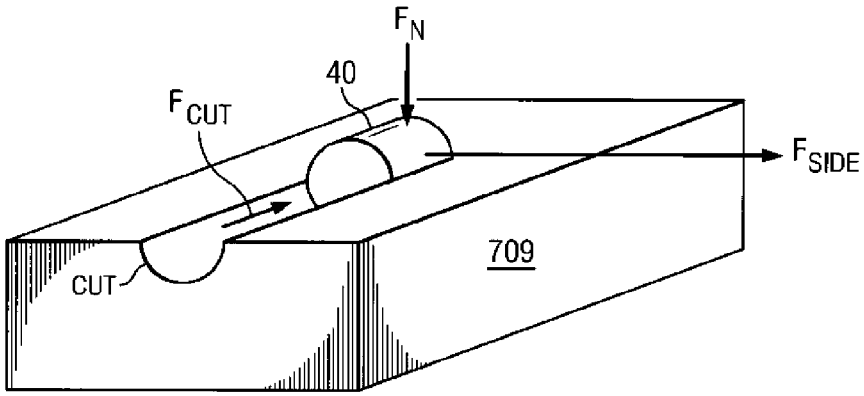
FIG. 14 shows an example of the forces applied on a cutter element when cutting through an earthen formation resolved into components in a Cartesian coordinate system along with corresponding parameters that can be used to describe cutter element/formation interaction during drilling.

The one or more properties of the bottom hole assembly may include, but are not limited to, impact force, drilling load, and wear rate. The impact force is the force exerted on an area of the bottom hole assembly, in particular the drill bit, resulting from the BHA striking the formation. The drilling load is the shearing force exerted on an area of the BHA, in particular the drill bit, from shearing the formation. The shearing force experienced by a cutter element includes a normal force, a side force and a cutting force. As shown in FIG. 14, the shearing force on the cutter elements can be resolved into a normal component (normal force) $F_N$, a cutting direction component (cut force) $F_{Cut}$, and a side component (side force) $F_{Side}$. Shearing force is related to the depth of cut for the cutter elements, the type of formation, the weight on bit (WOB), rotary torque, and the revolutions per minute (RPM) at which the drill bit is rotating. In the cutter element coordinate system shown in FIG. 14, the cutting axis is positioned along the direction of the cut. The normal axis is normal to the direction of the cut and generally perpendicular to the surface of the earthen formation 709 interacting with the cutter element 40. The side axis is parallel to the surface of the earthen formation 709 and perpendicular to the cutting axis. The origin of this cutter element coordinate system is shown positioned at the center of the cutter element 40. Lateral, axial, and torsional vibrations induced during drilling as well as bit whirl and stick-slip behavior can affect the impact force and drilling load experienced by the BHA and drill bit. "Stick-slip" behavior is well known in the art and is characterized by very substantial variations in the rotating speed of the drill bit as it is driven by means of a drill string brought into rotation from the surface at a substantially constant speed. The drill bit speed can range between a value that is practically zero and a value that is much greater than the rotating speed applied at the surface to the drill string. The wear rate is related to the sand content, the rock strength of the formation, and operating conditions, for example RPM at which the drill bit is rotating and force exerted on the cutter element. The wear rate includes both mechanical wear (for example wear resulting from physical contact) and thermal wear (for example wear resulting from temperature change).

The one or more properties of the BHA, in particular the drill bit, may be determined from data obtained from "offset wells" (wellbores drilled in the same area); or wellbores drilled in geologically similar areas; or by examining a dull drill bit removed from a wellbore. Alternatively, the one or more properties of the BHA, in particular the drill bit, may be determined using a computer modeling system. Such modeling systems are known, for example U.S. Patent Application No. 2004/0254664, filed Mar. 25, 2004; U.S. Patent Application No. 2005/0273301, filed Mar. 31, 2005; U.S. Patent Application No. 2006/0167669, filed Jan. 24, 2005; U.S. Patent Application No. 2006/0167668, filed Jan. 24, 2005; U.S. Patent Application No. 2006/0254829, filed May 13, 2005; U.S. Patent Application No. 2005/0273304, filed May 25, 2005; U.S. Patent Application No. 2006/0149518, filed Feb. 28, 2006; U.S. Patent Application No. 2007/0021857, filed Jul. 28, 2006; U.S. Patent Application No. 2007/0067147, filed Nov. 7, 2006; U.S. Patent Application No. 2007/0005316, filed Sep. 1, 2006; U.S. Patent Application No. 2007/0093996 to Cariveau et al.; U.S. Patent Application No. 2005/0133272 to Huang et al.; U.S. Patent Application No. 2005/0080595, U.S. Patent Application No. 2005/0015229, U.S. Patent Application No. 2005/0096847; U.S. Pat. No. 7,020,597, filed May 21, 2004; U.S. Pat. No. 7,139,689, filed May 24, 2004; U.S. Pat. No. 7,464,013, filed Apr. 6, 2005; U.S. Pat. No. 7,251,590, filed Mar. 21, 2006; U.S. Pat. No. 7,441,612, filed Jan. 11, 2006; U.S. Pat. No. 7,260,514, filed Dec. 10, 2004; U.S. Pat. No. 6,424,919, filed Jun. 26, 2000; U.S. Pat. No. 6,785,641, and U.S. Pat. No. 6,516,293, each to Huang; and U.S. Pat. No. 4,815,342, U.S. Pat. No. 5,010,789, U.S. Pat. No. 5,042,596, and U.S. Pat. No. 5,131,479, each to Brett et al., all of which are hereby incorporated by reference in their entireties.

Once the one or more properties of the BHA, in particular the drill bit, are determined, the arrangement or placement of the different cutter elements is determined based on the one or more properties of the BHA/drill bit and the one or more properties of the different cutter elements. This process may or may not be repeated. The one or more properties of the cutter elements may be selected from wear resistance, impact resistance, thermal stability, coefficient of friction, substrate hardness, fracture toughness of the substrate, and cutter element geometry. Impact resistance includes, but is not limited to, resistance to delamination, chipping and spalling. Wear resistance includes, but is not limited to, resistance to abrasion, corrosion, and erosion. Properties of the different cutter elements may be considered in combination with the properties of one or more areas of the BHA (e.g., the drill bit) and the different cutter elements may be positioned on the BHA (e.g., the drill bit) to provide optimum performance and/or cost effectiveness.

For example, an arrangement for the plurality of cutter elements may include one or more first cutter elements which may be positioned in one or more areas of the drill bit where the wear rate may be greater and impact and load properties may be less, where such first cutter elements have a greater thermal stability and wear resistance but less impact resistance than one or more second cutter elements. In this example, one or more second cutter elements may be positioned in one or more areas of the drill bit where the impact and load properties may be greater and wear rate may be less. Areas of the BHA where impact and/or load properties may be greater and wear rate may be less (for example areas of the cone region of the bit or the up-reaming region of the reamer/hole opener) may include a type of cutter element with better impact resistance, coefficient of friction, and/or substrate fracture toughness whereas areas where wear rate may be greater and load may be less (for example areas of the shoulder region, gage region, and gage pad of the bit and areas of the reamer section, if any) may include a type of cutter element with better wear resistance, thermal stability, and/or substrate hardness. Areas where impact, load and wear rate may be high (for example areas in the nose region and shoulder region; and in plural set cutter element designs for the leading primary cutter element and optionally the last primary cutter element on primary and/or secondary blades) may include one or more first cutter elements which may be a type of cutter element with a combination of properties which include good impact resistance (e.g., substantially the same as or greater than the second cutter elements) and excellent wear resistance and/or thermal stability (e.g., greater than the second cutter elements).

The one or more first cutter elements comprise a polycrystalline diamond construction which has a microstructure comprising a polycrystalline matrix first phase that is formed from bonded together diamond grains or crystals. The diamond body further includes interstitial regions disposed between the diamond crystals. The diamond body has been modified such that the interstitial regions of the diamond body are substantially free of the catalyst material used to form the diamond body under high pressure/high temperature conditions. In one region of the diamond body, the interstitial regions are filled with an infiltrant material that was not used to initially form the diamond body. In another region of the diamond body, the interstitial regions are substantially free of the infiltrant material. Such polycrystalline diamond constructions are described in U.S. 2008/0223623 A1, which is incorporated by reference in its entirety. The construction may additionally comprise a substrate that may be attached to the diamond body, thereby forming a compact construction. Such first cutter element can have improved thermal characteristics, such as thermal stability, as well as other properties (wear resistance, impact resistance, etc.) when compared to cutter elements having at least a portion of the interstitial regions of the diamond body containing catalyst material, as discussed hereinafter.

The polycrystalline diamond construction of the first cutter elements comprises a diamond body that has been specially treated so that the catalyst material is removed from the interstitial regions of the diamond body. The diamond body is subsequently treated so that the empty interstitial regions in one region comprise an infiltrate material, while the interstitial regions in another region of the diamond body remain empty or are further treated such that they are substantially free of the infiltrant material.

In an example embodiment, the diamond body may be specially treated so that more than 98% by weight of the catalyst material may be removed from the interstitial regions throughout the diamond body, in particular at least 99% w, more in particular at least 99.5% of the catalyst material may be removed from the interstitial regions throughout the diamond body. Without wishing to be bound by any particular theory, it is believed that by subjecting the diamond body to processing conditions sufficient to remove the catalyst material throughout the diamond body, more catalyst material may be removed from the interstitial regions than when subjecting the diamond body to processing conditions sufficient to remove the catalyst material from only a portion of the diamond body. Such additional catalyst material removal may lead to improved properties such as thermal stability and/or wear resistance which can lead to improved bit performance, in particular a more durable bit.

As used herein, the term "infiltrant material" is understood to refer to materials that are other than the catalyst material that was used to initially form the diamond body, and can include materials identified in Group VIII of the Periodic table (CAS version) that have subsequently been introduced into the sintered diamond body after the catalyst material used to form the same has been removed therefrom. The infiltrant material may be selected from the group of materials which include, but are not limited to, metals, ceramics, cermets, and combinations thereof. In an example embodiment, the infiltrant material may be a metal or metal alloy selected from Group VIII of the Periodic Table (CAS version in the CRC Handbook of Chemistry and Physics), such as cobalt, nickel, iron or combinations thereof, preferably cobalt. Additionally, the term "infiltrant material" is not intended to be limiting on the particular method or technique used to introduce such material into the interstitial regions of the already formed diamond body.

As used herein, the term "polycrystalline diamond" (PCD) refers to a material that has been formed at high pressure/high temperature (HPHT) conditions in the presence of a catalyst material and that has a material microstructure comprising a matrix phase of bonded together diamond crystals. The material microstructure further includes a plurality of interstitial regions that are disposed between the diamond crystals. In the first cutter elements, the interstitial regions are substantially free from the catalyst material that was used to initially form the matrix diamond phase.

Polycrystalline diamond constructions can be formed by conventional methods of subjecting precursor diamond grains (powder) to HPHT sintering conditions in the presence of a catalyst material, e.g., a solvent metal catalyst, that functions to facilitate the bonding together of the diamond grains at temperatures of between about 1350 to 1500° C., and pressures of 5000 MPa or greater. It is understood that such processing conditions can and will vary depending on such factors as the type and/or amount of solvent metal catalyst used, whether the solvent metal catalyst is combined with the precursor diamond or is provided from the substrate, as well as the type and/or amount of diamond powder used to form the diamond body or region.

Suitable catalyst material useful for making PCD includes those metals identified in Group VIII of the Periodic Table (CAS version), preferably cobalt. The solvent catalyst metal material can be added to the precursor diamond powder as a raw material powder prior to sintering, it can be contained within the diamond grains, or it can be infiltrated into the diamond powder during the sintering process from a substrate containing the solvent metal catalyst material that may be placed adjacent the precursor diamond and exposed to the HPHT sintering conditions (e.g., a tungsten carbide cobalt substrate). The type of catalyst material used in making the diamond body can affect the strength of the PCD or the degree of diamond bonding.

Diamond grains useful for forming the diamond body include synthetic or natural diamond powders having an average diameter grain size in the range of from submicron to 100 microns (micrometers), preferably in the range of from about 1 to about 80 microns. The diamond powder can contain grains having a mono- or multi-modal size distribution. In the event that diamond powders may be used having differently sized grains, the diamond grains may be mixed together by conventional process, such as by ball or attrittor milling for as much time as necessary to ensure good uniform distribution.

In an example embodiment, the diamond body of the cutter element may be prepared utilizing coarse diamond grain sizes, in particular diamond grain sizes of 25 microns or greater, in particular in the range of from 30 to 80 microns Use of larger diamond grain sizes may provide a more impact resistant cutter element. Alternatively, use of smaller diamond grain sizes may provide a more wear resistant cutter element. Multi-modal combinations of large and small diamond grain sizes may provide cutter elements with various properties.

Figure 5A:
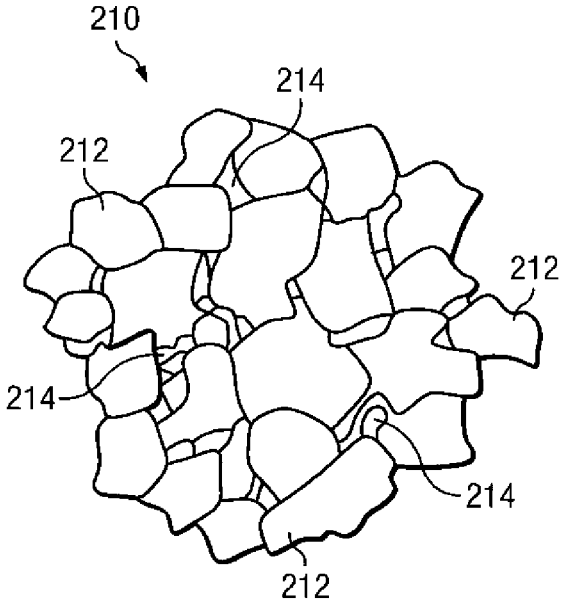
FIG. 5A is a schematic view of a region taken from a polycrystalline diamond body comprising an infiltrant material disposed interstitially between bonded together diamond crystals.

FIG. 5A schematically illustrates a region 210 of a polycrystalline diamond construction which includes the infiltrant material. Specifically, the region 210 includes a material microstructure comprising a plurality of bonded together diamond crystals 212, forming an intercrystalline diamond matrix first phase, and the infiltrant material 214 that is interposed within the plurality of interstitial regions that exist between the bonded together diamond crystals and/or that may be attached to the surfaces of the diamond crystals. For purposes of clarity, it is understood that the region 210 of the polycrystalline construction is one taken from a diamond body after it has been modified to remove the catalyst material that was used to initially form the diamond body.

As used herein, the term "removed" is used to refer to the reduced presence of a specific material in the interstitial regions of the diamond body, for example the reduced presence of the catalyst material used to initially form the diamond body during the sintering or HPHT process, or the reduced presence of an infiltrant material, or the reduced presence of a replacement material. It is understood to mean that a substantial portion of the specific material (e.g., catalyst material) no longer resides within the interstitial regions of the diamond body. However, it is to be understood that some small amounts of the material may still remain in the microstructure of the diamond body within the interstitial regions and/or remain adhered to the surface of the diamond crystals. Additionally, the term "substantially free", as used herein, is understood to mean that there may still be some small amounts of the specific material remaining within the interstitial regions of the diamond body. The quantity of the specific material remaining in interstitial regions after the diamond body has been subjected to treatment to remove the same can and will vary on such factors as the efficiency of the removal process, and the size and density of the diamond matrix material. The specific material to be removed from the diamond body may be removed by any suitable process, for example by chemical treatment such as by acid leaching or aqua regia bath.

After the diamond body of the first cutter elements has been treated to remove the catalyst material from the interstitial regions of the diamond body, a desired infiltrant material is introduced into at least a portion of the interstitial regions of the diamond body. The infiltrant material may be selected from the group of materials which include, but are not limited to, metals, ceramics, cermets, and combinations thereof. In an example embodiment, the infiltrant material may be a metal or metal alloy selected from Group VIII of the Periodic Table (CAS version described in the CRC Handbook of Chemistry and Physics), such as cobalt, nickel, iron or combinations thereof, preferably cobalt. It is to be understood that the choice of material or materials used as the infiltrant material can vary the properties of the cutter element, in particular the mechanical properties and/or thermal characteristics desired for the cutter element as discussed previously. In general, the greater the amount of infiltrant material the tougher the diamond body; however, greater amounts of infiltrant material can lower the thermal stability due to the different coefficients of thermal expansion between the infiltrant material and the diamond crystals.

The interstitial regions in the diamond body can be filled with the infiltrant material using a number of different techniques. Further, all of the interstitial regions or only a portion of the interstitial regions in the diamond body may be filled with the infiltrant material. In an example embodiment, the infiltrant material may be introduced into the diamond body by liquid-phase sintering under HPHT conditions. In such example embodiment, the infiltrant material can be provided in the form of a sintered part or a green-state part or a powder mixture or slurry that contains the infiltrant material and that may be positioned adjacent one or more surfaces of the diamond body. The assembly may be placed into a container that is subjected to HPHT conditions sufficient to melt the infiltrant material and cause it to infiltrate into the diamond body. In an example embodiment, the source of the infiltrant material may be a substrate that will be used to form a compact (e.g., cutter element) by attachment to the diamond body during the HPHT process.

As used herein, the term "filled" refers to the presence of the infiltrant material in the interstitial regions of the diamond body that resulted from removing the catalyst material used to form the diamond body therefrom and is understood to mean that a substantial volume of such interstitial regions contain the infiltrant material. However, it is to be understood that there may also be a volume of interstitial regions within the same region of the diamond body that do not contain the infiltrant material, and that the extent to which the infiltrant material effectively displaces the empty interstitial regions will depend on such factors as the particular microstructure of the diamond body, the effectiveness of the process used for introducing the infiltrant material, and the desired mechanical and/or thermal properties of the resulting polycrystalline diamond construction (i.e., cutter element). In an embodiment, when introduced into the diamond body, the infiltrant substantially fills all of the interstitial regions within the diamond body. In other embodiments, complete migration of the infiltrant material through the diamond body may not be realized, in which case a region of the diamond body may not include the infiltrant material. This region devoid of the infiltrant material from such incomplete migration may extend from the region comprising the infiltrant to a surface portion of the diamond body.

In an example embodiment, a substrate may be used as the source of infiltrant material, for example cobalt. The substrate used as the source of the infiltrant material may have the same composition and performance properties as the substrate which may have been used to form the diamond body. Alternatively, the substrate used as the source of the infiltrant material may have a different composition and performance properties from the substrate which may have been used to form the diamond body. For example, the substrate selected for sintering the diamond body may comprise a material composition that facilitates diamond bonding, but that may have poor erosion resistance and as a result would not be well suited for an end-use application in a drill bit. In this case, the substrate selected for providing the source of the infiltrant material can be selected from materials different from that of the sintering substrate, e.g., from materials capable of providing improved downhole properties such as erosion resistance when attached to a drill bit. Accordingly, it is to be understood that the substrate material selected as the infiltrant source may be different from the substrate material which may be used initially to sinter the diamond body.

Other processes may be used for introducing the infiltrant material into the diamond body. Such processes include, but are not limited to, chemical processes, electrolytic processes, etc.

In an example embodiment, the diamond body of the first cutter elements may have been chemically treated by acid leaching or aqua regia bath to render the interstitial regions in the diamond body substantially free of any catalyst material from the sintering process used to form the diamond body. After re-infiltration of the interstitial regions of the diamond body with an infiltrant material, the diamond body may be chemically treated by acid leaching or aqua regia bath in a region of the diamond body to render the interstitial regions in the region substantially free of any infiltrant material. Alternatively, the infiltration process may be controlled such that there is a region within the diamond body where the interstitial regions remain free of the infiltrant material. This region may be treated as a clean-up process to ensure a uniform region which is substantially free of infiltrant material. In one or more embodiments, the interstitial regions within the region of the diamond body of the first cutter elements free of catalyst material and infiltrant material may or may not contain a replacement material. In an example embodiment, the interstitial regions within the region of the diamond body of the first cutter elements free of catalyst material and infiltrant material may also be substantially free of any replacement materials. In an example embodiment, no replacement materials may be used to make the first cutter element.

A substrate may be attached to the diamond body during the HPHT process used to fill at least a portion of the interstitial regions of the diamond body with the infiltrant material. Alternatively, the substrate can be attached separately from the HPHT process used for filling, such as by a separate HPHT process, or by other attachment techniques such as brazing or the like.

When the one or more first cutter elements are prepared using two substrates, or precursors thereof, the finished first cutter elements can have a diamond body with an increased diamond density (i.e., diamond volume fraction) without the expected increase in residual stresses. Without wishing to be bound by any particular theory, it is believed that the removal of the substrate used to form the diamond body can reduce the residual stresses within the diamond body. The removal of the substrate occurs during the removal step of the catalyst material from throughout the diamond body. The subsequent reattachment of the diamond body to a second substrate, or precursor thereof, can create different and/or lesser residual stresses in the diamond body. Resulting in a finished first cutter element having increased diamond density and decreased residual stresses as compared to a cutter element with similar diamond density but prepared without removing the substrate used to form the diamond body. In some embodiments, after removal of the substrate used to form the diamond body, a portion of the diamond body surface (e.g., the side surfaces of the diamond body) may be removed. Without wishing to be bound by any particular theory, it is believed that this may also reduce stresses in the diamond body.

Once the diamond body has been filled with the infiltrant material, it may then be treated to remove a portion of the infiltrant material therefrom. The infiltrant material may be removed from a region adjacent a (working) surface of the diamond body. As used herein, a "working surface" of a diamond body is meant to include those surfaces of the diamond body initially utilized to shear the earthen formation. Alternatively, if the infiltrant material did not migrate completely through the diamond body, a subsequent infiltrant removal step may not be necessary, or may be useful as a clean-up process to ensure a uniform infiltrant removal depth. Techniques useful for removing a portion of the infiltrant material from the diamond body include the same as described above for removing the catalyst material used to initially form the diamond body.

In an example embodiment, it may be desired that the process of removing the infiltrant material be controlled so that the infiltrant material be removed from a targeted region of the diamond body extending a determined depth from one or more diamond body surfaces. These surfaces may include working and/or non-working surfaces of the diamond body.

In an example embodiment, the interstitial regions in the diamond body of the first cutter elements may be substantially free of the infiltrant material to a depth of less than about 0.25 mm from the desired surface or surfaces, preferably up to about 0.1 mm. In another example embodiment, the interstitial regions in the diamond body may be substantially free of the infiltrant material to a depth of less than about 0.5 mm from the desired surface or surfaces, preferably in the range of from about 0.3 mm to about 0.4 mm. Ultimately, the specific depth of the region formed in the diamond body that is substantially free of the infiltrant material will vary depending on the particular properties desired for the cutter element.

In an example embodiment, the amount of infiltrant material in the first region remote from the surface of the diamond body may be in the range of from 5% to 20% weight, in particular from 8% to 12% weight, based on the total weight of the diamond body in the first region. Greater levels of infiltrant material in the first region may improve the impact resistance of the cutter element.

Figure 5B:
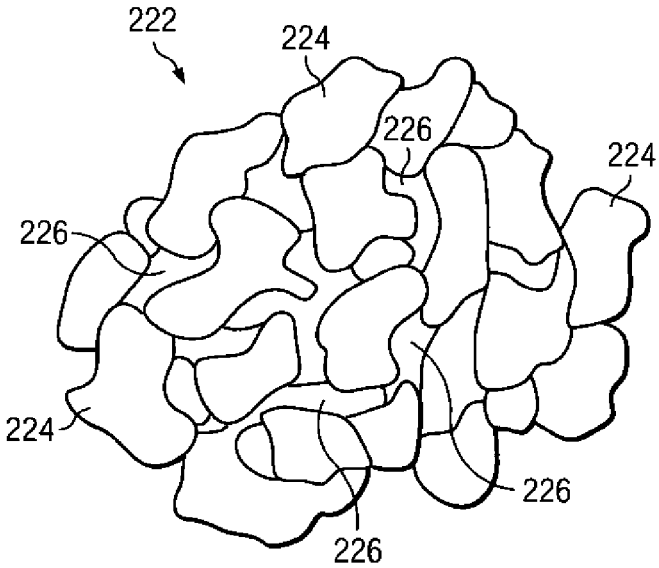
FIG. 5B is a schematic view of a region taken from a polycrystalline diamond body that is substantially free of the infiltrant material.

FIG. 5B schematically illustrates a region 222 of a polycrystalline diamond construction that is substantially free of the infiltrant material. Like the polycrystalline diamond construction region illustrated in FIG. 5A, the region 222 includes a material microstructure comprising the plurality of bonded together diamond crystals 224, forming the intercrystalline diamond matrix first phase. Unlike the region 210 illustrated in FIG. 5A, this region of the diamond body 222 has been modified to remove the infiltrant material from the plurality of interstitial regions and, thus comprises a plurality of interstitial regions 226 that are substantially free of the infiltrant material. Again, it is understood that the region 222 of the polycrystalline diamond construction is one taken from a diamond body after it has been modified to remove the catalyst material that was used to initially form the diamond body therefrom.

The diamond body may be configured to include the two above-described regions in the form of two distinct portions of the diamond body, or the diamond body may be configured to include the two above-described regions in the form of discrete elements that may be positioned at different locations within the diamond body, depending on the particular properties desired for the cutter element. For example, such cutter elements may provide improved wear resistance, in particular improved cutting properties as the discrete regions help to maintain the cutting surface (e.g., cutter "sharpness"). The diamond body may also be configured to include more than two regions.

Figure 6:
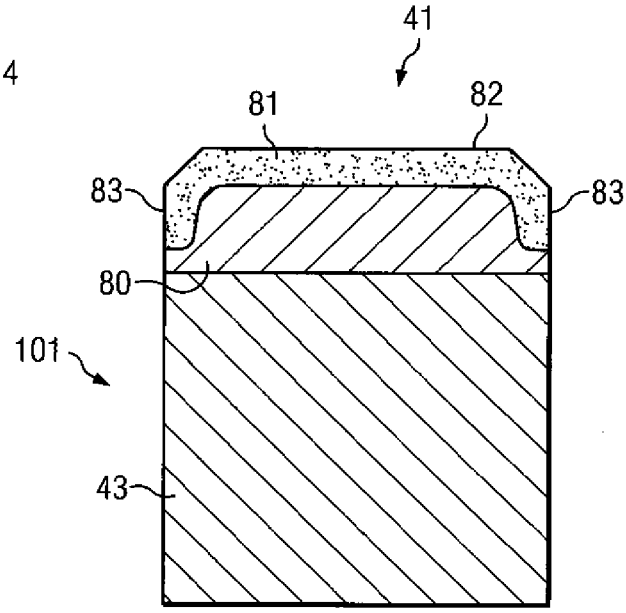
FIG. 6 is a cross-sectional view of a cutting element of the present disclosure comprising a substrate.

FIG. 6 illustrates an embodiment of a cutter element 101 comprising a diamond body 41 that is substantially free of the catalyst material used to form the matrix diamond phase bonded to a substrate 43. The diamond body 41 includes a first region 80 that is remote from the surfaces 82, 83, which includes an infiltrant material within the interstitial regions of the diamond body 41, and a second region 81 that is substantially free of the infiltrant material within the interstitial regions. The second region 81 extends a depth from surfaces 82 and 83 of the diamond body 41. In this particular embodiment, the surfaces include a top surface 82 and side surfaces 83 of the diamond body 41. The depth of the first region can be the same or different for the surfaces 82 and 83 depending on the particular properties desired for the cutter element. Additionally, the extent of the side surfaces that include the second region can vary from extending along the entire side of the diamond body to extending only along a partial length of the side of the diamond body.

It is believed, for reasons not completely understood, that preparing the first cutter element using two or more pressing processes (HPHT processes) with removal of the catalyst material in between can result in improved cutter elements as compared to other cutter elements, for example a cutter element prepared using only one pressing process (HPHT process) with partial or no removal of the catalyst material.

In one or more embodiments, an intermediate material may be interposed between a substrate and the diamond body, if desired. Such intermediate materials or layers are described in U.S. 2008/0223621 to Middlemiss et al. and U.S. 2008/0223623 to Keshavan et al., which descriptions are incorporated herein by reference. Use of such intermediate layers may provide one or more different properties to the cutter element.

In one or more embodiments, instead of a planar geometry between the diamond body and the substrate, the cutter element may have a non-planar geometry, e.g., having a convex configuration, or a concave configuration, or having one or more surface features that project from one or both of the diamond body and substrate. Such a non-planar interface may be desired for the purpose of enhancing the surface area of contact between the attached diamond body and substrate, and/or for the purpose of enhancing heat transfer therebetween, and/or for the purpose of reducing the degree of residual stress imposed on the diamond body. Additionally, the diamond body surfaces can be configured differently from a planar surface. Such non-planar geometries may provide one or more different properties to the cutter element.

In one or more embodiments, the polycrystalline diamond construction may comprise a diamond body having properties of diamond density, infiltrant material concentration, and/or diamond grain size that changes as a function of position within the diamond body. For example, the diamond body may have a gradient in diamond density, infiltrant material concentration, and/or diamond grain size that changes in a smooth or step-wise fashion moving away from a working surface of the diamond body. Further, rather than being formed as a single mass, the diamond body used in forming the polycrystalline construction may be provided in the form of a composite construction formed from a number of diamond bodies that have been combined together, wherein each such body may have the same or different properties such as diamond grain size, infiltrant material concentration, diamond density, or the like. Such gradients may provide one or more different properties to the cutter element.

In one or more embodiments, the one or more second cutter elements may also be comprised of a thermally stable polycrystalline diamond cutter element as described above; however, the second cutter elements have one or more properties that differ from the first cutter elements. Suitably, the second cutter elements may differ from the first cutter elements with respect to impact resistance and one or more additional properties. As used herein to compare or claim different properties of cutter elements, the terms different or differ are not meant to include typical variations in the manufacture of a cutter element.

In one or more embodiments, the diamond body of the second cutter elements may or may not comprise a replacement material instead of an infiltrant material or in combination with an infiltrant material depending on the properties desired for the cutter element. The replacement material may include any suitable material which is a non-catalyzing material or non-infiltrant material and which has a coefficient of thermal expansion that is relatively closer to (more closely matches) that of diamond than that of the catalyst material or infiltrant material. For example, the replacement material may include non-refractory metals, ceramics, silicon and silicon-containing compounds, ultrahard materials such as diamond and cubic boron nitride, Group IB elements of the Periodic table such as copper, and mixtures thereof. Such cutter elements are described in U.S. 2008/0230280 A1 to Keshavan et al. and U.S. Pat. No. 5,127,923 to Bunting et al., which descriptions are incorporated herein by reference. The diamond body has a material microstructure comprising a matrix phase of bonded together diamond crystals formed at HPHT conditions in the presence of a catalyst material. The diamond body has a surface and includes interstitial regions disposed between the diamond crystals. The interstitial regions throughout the diamond body may be substantially free of the catalyst material.

In an example embodiment, the diamond body of the second cutter element has a first region positioned remote from the surface of the diamond body and comprises a replacement material disposed within the interstitial regions. The diamond body has a second region which comprises interstitial regions that are substantially free of the replacement material and any infiltrant material. The diamond body is also substantially free of the catalyst material throughout the diamond body. Suitable depths for such regions that may be substantially free of replacement material and any infiltrant material are similar to those discussed hereinbefore. The choice of material or materials used as a replacement material can and will vary depending on the desired properties of the cutter element such as the desired mechanical properties and/or thermal characteristics as discussed previously.

In an example embodiment, the diamond body of the second cutter element has a first region positioned remote from the surface of the diamond body and comprises an infiltrant material disposed within the interstitial regions. The diamond body has a second region which comprises interstitial regions that contain a replacement material and are substantially free of the infiltrant material. The diamond body is also substantially free of the catalyst material throughout the diamond body. Suitable depths for such regions that may be substantially free of replacement material and any infiltrant material are similar to those discussed hereinbefore. The choice of material or materials used as a replacement material can and will vary depending on the desired properties of the cutter element such as the desired mechanical properties and/or thermal characteristics as discussed previously. The replacement material may be disposed within the interstitial regions during the same HPHT process utilized to introduce the infiltrant material into the interstitial regions by placing a material containing the replacement material adjacent the desired portion of the diamond body surface. The form of the material containing the replacement material may be similar to that discussed herein for the infiltrant material. Alternatively, the infiltrant material may be introduced into the interstitial regions of the diamond body; subsequently the infiltrant material may be removed from a second region along at least a portion of the surface of the diamond body leaving a first region remote from the upper surface of the diamond body containing the infiltrant material disposed within the interstitial regions; and then the replacement material may be introduced into the interstitial regions of the second region. The diamond body is also substantially free of the catalyst material throughout the diamond body.

In one or more embodiments, the second cutter element may be a standard cutter element comprising a cutting layer (i.e., cutting table) and optionally a metal carbide substrate. The cutting layer may be made from an ultra hard material such as polycrystalline diamond (PCD) or polycrystalline cubic boron nitride (PCBN). For example, a standard polycrystalline diamond cutter element may have a diamond body which has a material microstructure comprising a matrix phase of bonded together diamond crystals formed at HPHT conditions in the presence of catalyst material. The diamond body has a surface and interstitial regions disposed between the diamond crystals. The interstitial regions have the catalyst material disposed therein throughout the diamond body.

Suitably, the substrate which may be contained in the cutter elements of the various example embodiments may comprise a sintered metal carbide. Suitably, the metal of the metal carbide may be selected from chromium, molybdenum, niobium, tantalum, titanium, tungsten and vanadium and alloys and mixtures thereof. For example, sintered tungsten carbide may be formed by sintering a mixture of stoichiometric tungsten carbide and a metal binder. The metal binder may also be the catalyst material and/or infiltrant material. The amount of metal binder may be in the range of from 2 to 25% weight, based on the total weight of the substrate. A greater amount of metal binder in the substrate may improve fracture toughness of the substrate while a lesser amount of metal binder may improve wear resistance of the substrate, in particular hardness, abrasion resistance, corrosion resistance, and erosion resistance. The particle sizes of the metal carbide used to form the sintered metal carbide may also be varied. Larger particle sizes of greater than 6 microns, in particular in the range of from 8 to 16 microns may be used. Use of larger particle sizes of the metal carbide may also provide improved fracture toughness. Smaller particle sizes of 6 microns or less, in particular in the range of from 1 micron to 6 microns may also be used. Use of smaller particle sizes of the metal carbide may also provide improved wear resistance of the substrate, in particular improved erosion resistance, and hardness. The particle sizes of the metal carbide may also be multi-modal which may provide substrates and cutter elements with various properties.

In one or more embodiments, the second cutter element may be a standard cutter element, as described above, which additionally has a first region comprising the catalyst material disposed within the interstitial regions and remote from the surface and a second region comprising interstitial regions that are substantially free of the catalyst material. In an example embodiment, the interstitial regions may be substantially free of the catalyst material in the second region to a depth of less than about 0.25 mm from the desired surface or surfaces, preferably up to about 0.1 mm. In some example embodiments, the interstitial regions may be substantially free of the catalyst material in the second region to a depth of less than about 0.5 mm from the desired surface or surfaces, preferably in the range of from about 0.3 mm to about 0.4 mm. Ultimately, the specific depth of the region formed in the diamond body that may be substantially free of the catalyst material will vary depending on the particular properties desired for the cutter element.

In one or more embodiments, the second cutter element may also have intermediate layers as well as planar and non-planar interfaces and surfaces, as discussed above. In an example embodiment, the second cutter element may also comprise a diamond body having properties of diamond density, infiltrant material concentration, and/or diamond grain size that change as a function of position within the diamond body, as discussed above. Such variations may provide one or more different properties to the cutter element.

In one or more embodiments, the plurality of cutter elements may further comprise one or more third cutter elements. In this embodiment, the third cutter elements have one or more different properties than the first cutter elements and the second cutter elements. The third cutter elements may be selected from any of the cutter elements disclosed above for the second cutter elements.

In one or more embodiments, the plurality of cutter elements for use with the BHA may further comprise one or more fourth cutter elements each differing from the first, second, and third cutter elements by at least one or more properties.

In FIG. 1, the drill bit 10 generally includes a bit body 12, a shank 13 and a threaded connection or pin 14 for connecting the bit 10 to a drill string (not shown) which is employed to rotate the bit in order to drill the borehole. Bit face 20 supports a cutting structure 15 and is formed on the end of the bit 10 that is opposite pin end 16. Bit 10 further includes a central axis 11 about which bit 10 rotates in the cutting direction represented by arrow 18. Bit body 12 may be formed in a conventional manner by placing metal carbide particles (e.g., tungsten carbide) into a mold (e.g., graphite mold) and infiltrating the metal carbide particles (e.g., powdered tungsten carbide particles) with a binder material (e.g., a copper-based alloy) to form a hard metal cast matrix. Such methods of manufacturing are described in U.S. Patent Application No. 2009/0260893, filed Aug. 12, 2008, and U.S. Pat. No. 6,287,360, filed Sep. 18, 1998, which descriptions are incorporated herein by reference. Alternatively, the body can be machined from a metal block, such as steel, rather than being formed from a matrix material. Such methods of manufacturing steel bit bodies are described in U.S. Patent Application No. 2008/0053709, filed Aug. 29, 2006, which description is incorporated herein by reference.

Figure 7:
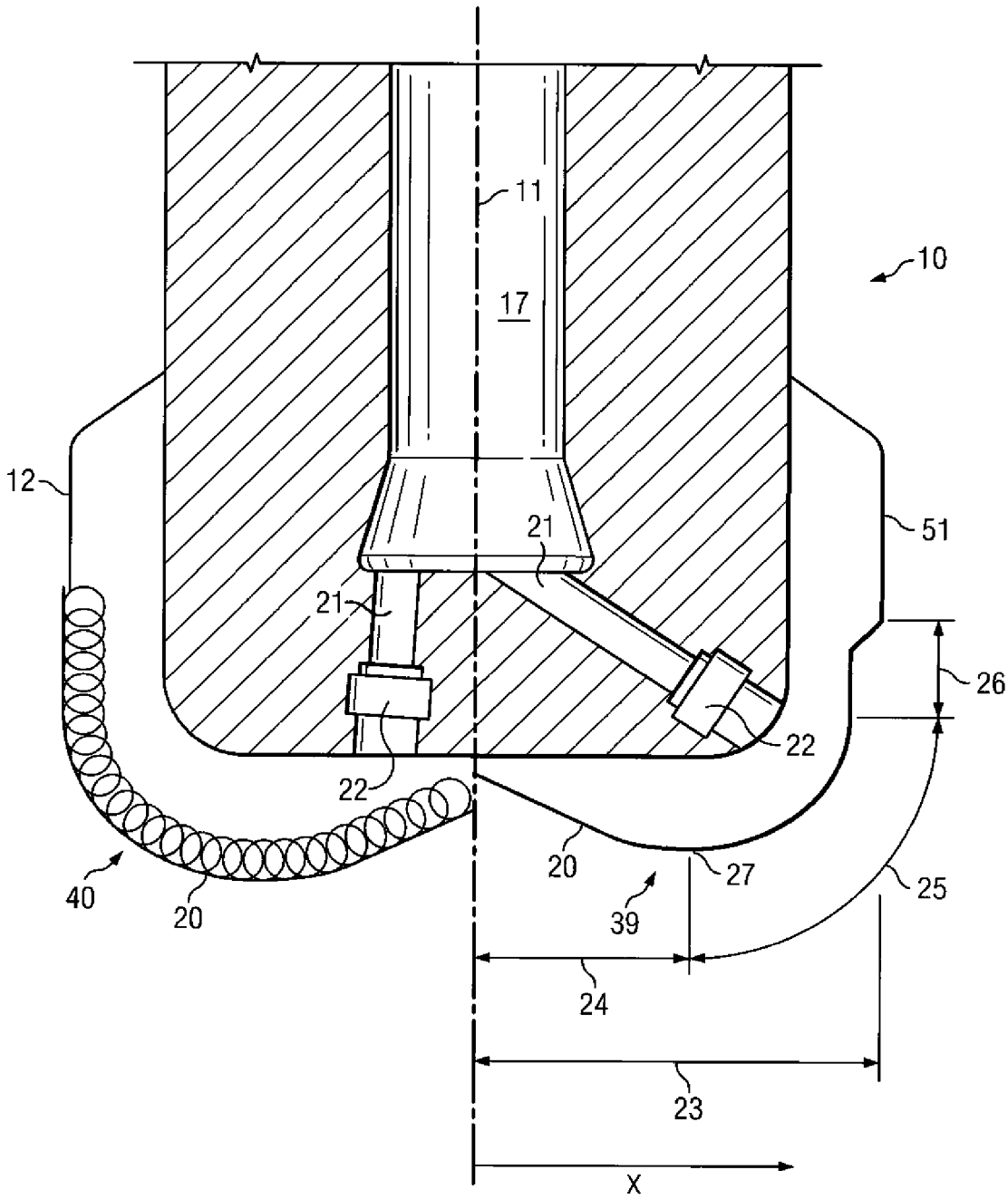
FIG. 7 is a partial cross-sectional view of the bit shown in FIG. 1 with the cutter elements of the bit shown rotated into a single profile.

As seen in FIG. 7, the bit body 12 may include a central longitudinal bore 17 permitting drilling fluid to flow from the drill string into the bit body 12. Bit body 12 is also provided with downwardly extending flow passages 21 having ports or nozzles 22 disposed at their lowermost ends. The flow passages 21 are in fluid communication with central bore 17. Together, passages 21 and nozzles 22 serve to distribute drilling fluids around a cutting element to flush away formation cuttings during drilling and to remove heat from the bit 10. FIG. 7 is an exemplary profile of a fixed cutter rotary bit 10 shown as it would appear with all blades (e.g., primary blades 31, 32, 37 and secondary blades 33-35) and all cutter elements (e.g., primary cutter elements 40 and backup cutter elements 50) rotated into a single rotated profile.

Referring again to FIG. 1, cutting structure 15 is provided on the bit face 20 of the bit 10. Cutting structure 15 includes a plurality of blades which extend from bit face 20. In an example embodiment, cutting structure 15 includes three angularly spaced apart primary blades 31, 32, 37 and three angularly spaced apart secondary blades 33, 34, 35. In this embodiment, the plurality of blades are spaced generally uniformly about the bit face 20. In addition, the three primary blades 31, 32, 37 are spaced uniformly (e.g., about 120° apart). In other embodiments (not specifically illustrated), the blades may be spaced non-uniformly about bit face 20.

In this embodiment, each primary blade 31, 32, 37 includes a cutter-supporting surface 42 for mounting a plurality of cutter elements, and each secondary blade 33-35 includes a cutter-supporting surface 52 for mounting a plurality of cutter elements. In particular, primary cutter elements 40 having primary cutting faces 44 are mounted to primary blades 31, 32, 37 and secondary blades 33-35. Further, backup cutter elements 50 having backup cutting faces 54 are mounted to primary blades 31, 32, 37. Optionally, the bit face may also contain one or more depth-of-cut limiters 55 extending from the cutter-supporting surface 42, 52.

Figure 8:
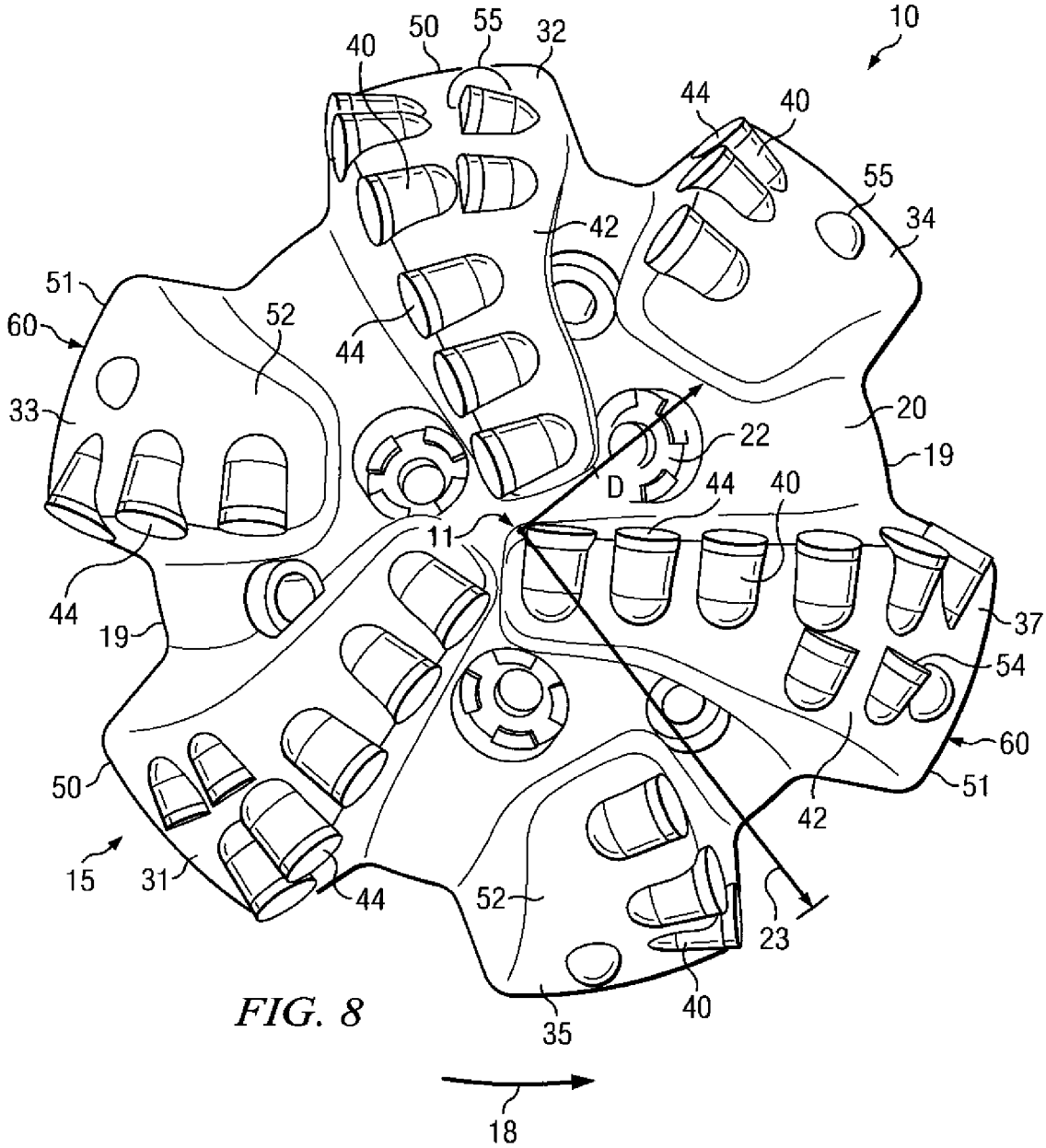
FIG. 8 is a top view of the bit shown in FIG. 1.

Still referring to FIG. 1, primary blades 31, 32, 37 and secondary blades 33-35 are integrally formed as part of, and extend from, bit body 12 and bit face 20. Primary blades 31, 32, 37 and secondary blades 33, 34, 35 extend radially across bit face 20 and longitudinally along a portion of the periphery of bit 10. Primary blades 31, 32, 37 extend radially from substantially proximal central axis 11 toward the periphery of bit 10. Thus, as used herein, the term "primary blade" is used to describe a blade that extends from substantially proximal central axis 11. Secondary blades 33, 34, 35 do not extend from substantially proximal central axis 11. As best seen in FIG. 8, secondary blades extend radially from a location that is a distance "D" away from central axis 11. Thus, as used herein, the term "secondary blade" is used to describe a blade that does not extend from substantially proximal central axis 11. Primary blades 31, 32, 37 and secondary blades 33-35 are separated by drilling fluid flow courses 19.

In different example embodiments (not specifically illustrated), bit 10 may comprise a different number of primary blades and/or secondary blades than that shown in FIGS. 1 and 8. In general, the bit may include one or more primary blades and optionally one or more secondary blades. For example, the bit may comprise at least two primary blades, suitably in the range of from 3 to 9, more suitably in the range of 3 to 7, and optionally at least two secondary blades, suitably in the range of from 3 to 12.

Each blade on the bit face 20 (e.g., primary blades 31, 32, 37 and secondary blades 33-35) provides a cutter-supporting surface 42, 52 to which cutter elements are mounted. In the example embodiment illustrated in FIGS. 1 and 8, primary cutter elements 40 are disposed on the cutter-supporting surface 42 of primary blades 31, 32, 37 and on the cutter supporting surface 52 of secondary blades 33-35. Additionally, one or more of the primary blades 31, 32, 37 also may have backup cutter elements 50 disposed on the cutter-supporting surface 42 in the shoulder region of the bit. In a different example embodiment (not specifically illustrated in FIGS. 1 and 8), backup cutter elements may be provided on the cutter-supporting surface of one or more of the primary blades in the cone region. In a different example embodiment (not specifically illustrated in FIGS. 1 and 8), backup cutter elements may be provided on the cutter-supporting surface of any one or more secondary blades in the shoulder and/or gage region. In an example embodiment (not specifically illustrated in FIGS. 1 and 8), backup cutter elements may be provided on the cutter-supporting surface of any one or more primary blades in the gage region. In an example embodiment (not specifically illustrated in FIGS. 1 and 8), the primary and/or secondary blades may have at least two rows of backup cutter elements disposed on the cutter supporting surfaces 42, 52.

Primary cutter elements 40 are positioned adjacent one another generally in a first row extending radially along each primary blade 31, 32, 37 and along each secondary blade 33-35. Further, backup cutter elements 50 are positioned adjacent one another generally in a second row extending radially along each primary blade 31, 32, 37 in the shoulder region. Suitably, the backup cutter elements 50 may form a second row that may extend along each primary blade in the shoulder region, cone region and/or gage region, such as in this embodiment in the shoulder region. Backup cutter elements 50 are positioned behind the primary cutter elements 40 provided on the same primary blade 31, 32, 37. Backup cutter elements 50 trail the primary cutter elements 40 provided on the same primary blade 31, 32, 37.

Thus, as used herein, the term "backup cutter element" is used to describe a cutter element that trails any other cutter element on the same blade when bit 10 is rotated in the cutting direction represented by arrow 18. Further, as used herein, the term "primary cutter element" is used to describe a cutter element provided on the leading edge of a blade. In other words, when bit 10 is rotated about central axis 11 in the cutting direction of arrow 18 a "primary cutter element" does not trail any other cutter elements on the same blade. Suitably, each primary cutter element and optional backup cutter element may have any suitable size and geometry. Primary cutter elements and backup cutter elements may have any suitable location and orientation. In an example embodiment, backup cutter elements may be located at the same radial position (within standard manufacturing tolerances) as the primary cutter element it trails, or backup cutter elements may be offset from the primary cutter element it trails, or combinations thereof may be used.

In one or more embodiments, cutting faces (i.e., the upper surface of the cutting table of the cutter element) of the primary cutter elements may have a greater extension height than the cutting faces of the backup cutter elements (i.e., "on-profile" primary cutter elements engage a greater depth of the formation than the backup cutter elements; and the backup cutter elements are "off-profile"). As used herein, the term "off-profile" may be used to refer to a structure extending from the cutter-supporting surface (e.g., cutter element, depth-of-cut limiter, etc.) that has an extension height less than the extension height of one or more other cutter elements that define the outermost cutting profile of a given blade. As used herein, the term "extension height" is used to describe the distance a cutter face extends from the cutter-supporting upper surface of the blade to which it is attached. In other example embodiments, one or more backup cutting faces may have the same or a greater extension height than one or more primary cutting faces. Such variables may impact the properties of the BHA, in particular the drill bit, which can affect the arrangement or positioning of the different types of cutter elements. For example, "on-profile" cutter elements may experience a greater amount of wear and load than "off-profile" cutter elements. Also, primary cutter elements may experience a greater amount of wear and load than back-up cutter elements.

In general, primary cutter elements 40 and backup cutter elements 50 need not be positioned in rows, but may be mounted in other suitable arrangements provided each cutter element is either in a leading position (e.g., primary cutter element 40) or trailing position (e.g., backup cutter element 50). Examples of suitable arrangements may include without limitation, rows, arrays or organized patterns, randomly, sinusoidal pattern, or combinations thereof. Further, in other embodiments (not specifically illustrated), additional rows of cutter elements may be provided on a primary blade, secondary blade, or combinations thereof.

Still referring to FIGS. 1 and 8, bit 10 further includes gage pads 51 of substantially equal length that are disposed about the circumference of bit 10 at angularly spaced locations. Gage pads 51 intersect and extend from blades 31-35 and 37, respectively. Gage pads 51 are integrally formed as part of the bit body 12.

As shown in FIGS. 1 and 8, each gage pad 51 includes a generally gage-facing surface 60 and a generally forward-facing surface 61 which intersect in an edge 62, which may be radiused, beveled or otherwise rounded. Gage-facing surface 60 includes at least a portion that extends in a direction generally parallel to bit axis 11 and extends to full gage diameter. In other example embodiments, other portions of gage-facing surface 60 may be angled, and thus slant away from the borehole sidewall. Also, in select example embodiments, forward-facing surface 61 may likewise be angled relative to central axis 11 (both as viewed perpendicular to central axis 11 or as viewed along central axis 11). Surface 61 is termed generally "forward-facing" to distinguish that surface from the gage surface 60, which generally faces the borehole sidewall. Gage-facing surface 60 of gage pads 51 abut the sidewall of the borehole during drilling; the pads can help maintain the size of the borehole by a rubbing action when primary cutter elements 40 wear slightly under gage. The gage pads also help stabilize the bit against vibration.

In one or more embodiments, (not specifically illustrated), certain gage pads 51 may include cutter elements. Further, in other example embodiments (not specifically illustrated), no gage pads 51 are provided on bit 10. Cutter elements may be embedded in gage pads 51 and protrude from the gage-facing surface 60 or forward-facing surface 61 of gage pads 51.

Referring to FIG. 7, blade profiles 39 and bit face 20 may be divided into three different regions: cone region 24, shoulder region 25, and gage region 26. Cone region 24 is concave in this example embodiment and comprises the inner most region of bit 10 (e.g., cone region 24 is the central most region of bit 10). Adjacent cone region 24 is shoulder (or the upturned curve) region 25. Next to shoulder region 25 is the gage region 26 which is the portion of the bit face 20 which defines the outer radius 23 of the bit 10. Outer radius 23 extends to and therefore defines the full diameter of bit 10. As used herein, the term "full gage diameter" is used to describe elements or surfaces extending to the full, nominal gage of the bit diameter.

Still referring to FIG. 7, cone region 24 is defined by a radial distance along the x-axis measured from central axis 11. It is to be understood that the x-axis is perpendicular to the central axis 11 and extends radially outward from central axis 11. Cone region 24 may be defined by a percentage of the outer radius 23 of bit 10. In one or more embodiments, cone region 24 extends from central axis 11 to no more than 50% of outer radius 23. In one or more embodiments, cone region 24 extends from central axis 11 to no more than 30% of the outer radius 23. Cone region 24 may likewise be defined by the location of one or more secondary blades (e.g., secondary blades 33-35). For example, cone region 24 extends from central axis 11 to a distance at which a secondary blade begins (e.g., distance "D" illustrated in FIG. 8). In other words, the outer boundary of cone region 24 may coincide with the distance "D" at which one or more secondary blades begin. The actual radius of cone region 24, measured from central axis 11, may vary from bit to bit depending on a variety of factors including without limitation, bit geometry, bit type, location of one or more secondary blades, or combinations thereof. For instance, in some cases bit 10 may have a relatively flat parabolic profile resulting in a cone region 24 that is relatively large (e.g., 50% of outer radius 23). However, in other cases, bit 10 may have a relatively long parabolic profile resulting in a relatively smaller cone region 24 (e.g., 30% of outer radius 23). Adjacent cone region 24 is shoulder (or the upturned curve) region 25. In this embodiment, shoulder region 25 is generally convex. The transition between cone region 24 and shoulder region 25 occurs at the axially outermost portion of composite blade profile 39 (lowermost point on bit 10 in FIG. 7), which is typically referred to as the nose or nose region 27. Next to the shoulder region 25 is the gage region 26 which extends substantially parallel to central axis 11 at the outer radial periphery of composite blade profile 39.

Suitably, the cone region extends radially from the central axis of the bit to a cone radius $R_c$, shoulder region extends radially from cone radius $R_c$ to shoulder radius $R_s$. Optionally, the gage region may extend radially from shoulder $R_s$ to gage $R_g$.

In an example embodiment, the secondary blades may extend significantly into the cone region, in other example embodiments, one or more secondary blades may begin at the cone radius (e.g., cone radius $R_c$) and extend toward gage region. In an example embodiment, one or more of the primary and/or secondary blades may extend substantially to the gage region and outer radius/outer diameter of the bit. However, in other example embodiments, one or more of the primary and/or secondary blades may not extend completely to the gage region or outer radius/outer diameter of the bit.

Blade profiles 39 and bit face 20 may also be described as two regions termed "inner region" and "outer region", where the "inner region" is the central most region of bit 10 and is analogous to cone region 24, and the "outer region" is simply the region(s) of bit 10 outside the inner region. Using this nomenclature, the outer region is analogous to the combined shoulder region 25 and the gage region 26 previously described. The inner region may be defined similarly to cone region 24 (e.g., by a percentage of the outer radius 23, by distance "D", etc.).

In an example embodiment, the first and second cutter elements may be arranged such that the cone region contains a combination of first and second cutter elements. Suitably, there may be at least one first cutter element and at least one second cutter element in the cone region, in particular there may be a plurality of first cutter elements (for example 2, 3, 5, 10, 15, 20, 25, or 30) and a plurality of second cutter elements (for example 2, 3, 5, 10, 15, 20, 25, or 30). Suitably, the first and/or second cutter elements in the cone region may be primary and optionally backup cutter elements. Suitably, the shoulder region may contain first and/or second cutter elements. Suitably, there may be at least one first cutter element and/or at least one second cutter element in the shoulder region, in particular there may be a plurality of first cutter elements (for example 2, 5, 10, 15, 20, 25, 50, 75, or 100) and/or a plurality of second cutter elements (for example 2, 5, 10, 15, 20, 25, 50, 75, or 100). Suitably, the gage region may contain first and/or second cutter elements. Suitably, there may be at least one first cutter element and/or at least one second cutter element in the gage region, in particular there may be a plurality of first cutter elements (for example 2, 5, 10, 15, 20, 25, 30, or 50) and/or a plurality of second cutter elements (for example 2, 5, 10, 15, 20, 25, 30, or 50). Suitably, the first and/or second cutter elements in the shoulder and/or gage region may be primary and/or backup cutter elements. Suitably, the first and/or second cutter elements in the shoulder and gage regions may be disposed on the primary blades and/or the secondary blades.

In a different example embodiment, the first and second cutter elements may be arranged such that the cone region contains the second cutter element. The second cutter element in the cone region may be a primary and optionally a backup cutter element. Suitably, there may be a plurality of second cutter elements in the cone region, for example 2, 3, 5, 10, 15, 20, 25, or 30. The cone region may or may not contain the thermally stable polycrystalline cutter elements as described above containing an infiltrant material. Suitably, the shoulder region may contain the first and/or second cutter elements and the gage region may also contain the first and/or second cutter elements. Suitably, the shoulder region may contain first and second cutter elements. Suitably, there may be at least one first cutter element and/or at least one second cutter element in the shoulder region, in particular there may be a plurality of first cutter elements (for example 2, 5, 10, 15, 20, 25, 50, 75, or 100) and/or a plurality of second cutter elements (for example 2, 5, 10, 15, 20, 25, 50, 75, or 100). Suitably, there may be at least one first cutter element and/or at least one second cutter element in the gage region, in particular there may be a plurality of first cutter elements (for example 2, 5, 10, 15, 20, 25, 30, or 50) and/or a plurality of second cutter elements (for example 2, 5, 10, 15, 20, 25, 30, or 50). Suitably, the first and/or second cutter elements in the shoulder and/or gage region may be primary and/or backup cutter elements. Suitably, the first and/or second cutter elements in the shoulder and gage regions may be disposed on the primary blades and/or the secondary blades. In other embodiments, the primary cutter elements in the shoulder region on one or more primary blades may comprise a majority of first cutter elements, suitably at least 60% may be first cutter elements, more suitably at least 75% may be first cutter elements, most suitably all of the primary cutter elements may be first cutter elements, as the shoulder region generally benefits the most from the properties of the first cutter element (e.g., thermal stability, wear resistance, etc.). Optionally, the first primary cutter element in the gage region on one or more primary blades may be a first cutter element. This area can also benefit from the properties of the first cutter element. In one or more embodiments, the remaining cutter elements in other areas may be cutter elements other than first cutter elements, and suitably, may not be thermally stable polycrystalline diamond cutter elements containing an infiltrant material.

Additionally, in one or more embodiments, the primary cutter elements in the shoulder region on one or more secondary blades may also comprise a majority of first cutter elements, suitably at least 60% may be first cutter elements, more suitably at least 75% may be first cutter elements, most suitably all of the primary cutter elements may be first cutter elements, as this area can also benefit from the properties of the first cutter element. Optionally, the first primary cutter element in the gage region on one or more secondary blades may be a first cutter element. In one or more embodiments, the remaining cutter elements in other areas may be cutter elements other than first cutter elements and suitably may not be thermally stable polycrystalline diamond cutter elements containing an infiltrant material.

Additionally, in one or more embodiments, the back-up cutter elements in the shoulder region on one or more primary blades may also comprise a majority of first cutter elements, suitably at least 60% may be first cutter elements, more suitably at least 75% may be first cutter elements, most suitably all of the back-up cutter elements may be first cutter elements. In one or more embodiments, the remaining cutter elements in other areas may be cutter elements other than first cutter elements, and suitably, may not be thermally stable polycrystalline diamond cutter elements containing an infiltrant material.

Additionally, in one or more embodiments, the back-up cutter elements in the shoulder region on one or more secondary blades may also comprise a majority of first cutter elements, suitably at least 60% may be first cutter elements, more suitably at least 75% may be first cutter elements, most suitably all of the back-up cutter elements may be first cutter elements. In one or more embodiments, the remaining cutter elements in other areas may be cutter elements other than first cutter elements and suitably may not be thermally stable polycrystalline diamond cutter elements containing an infiltrant material.

The arrangements of the example embodiments may also include one or more additional different cutter elements, for example one or more third or fourth cutter elements. The additional cutter elements may be positioned within the cone, shoulder and/or gage regions as primary and/or backup cutter elements on the primary blades and/or secondary blades.

In the example embodiments, the properties of the first, second and optionally any additional cutter elements as well as the properties of the BHA, in particular the drill bit, may be considered and a determination made as to the optimal arrangement based on the different properties.

Figure 9:
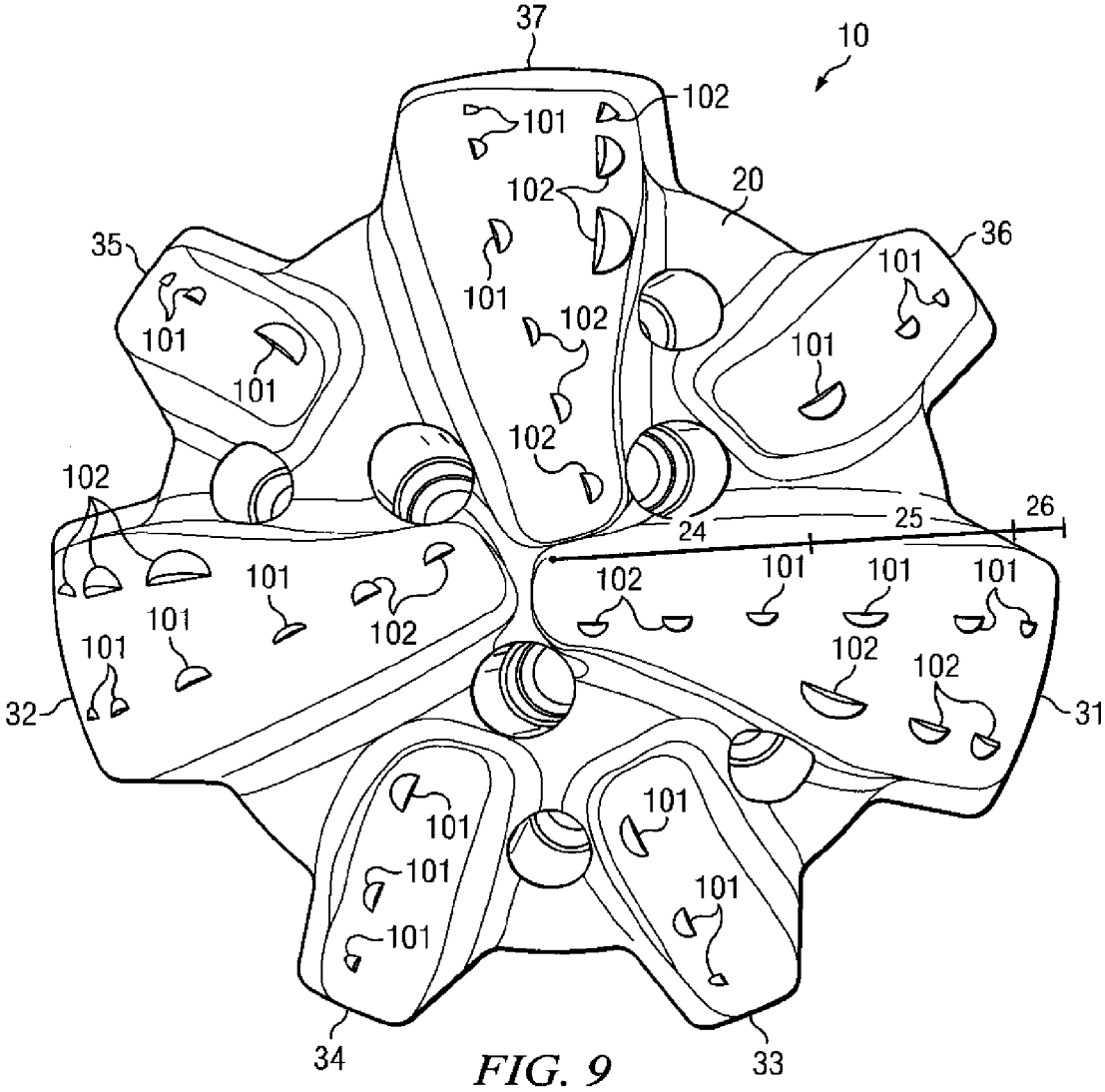
FIG. 9 is a schematic top view of a bit made in accordance with the principles described herein.

FIG. 9 is a schematic top view of a bit made in accordance with the principles described herein. As discussed above, bit 10 may comprise a bit face 20 having a cone region 24, a shoulder region 25, and a gage region 26. In this example embodiment, bit 10 has primary blades 31, 32, and 37 and secondary blades 33-36. In this example embodiment, primary blades 31, 32, 37 and secondary blades 33-36 taper (e.g., become thinner) as the blades extend inward toward the central axis (not shown). In different example embodiments (not specifically illustrated), one or more primary blades 31, 32 and 37, or one or more secondary blades 33-36, or combinations thereof may be uniform or taper towards full gage radius. Further, the taper may be linear or non-linear. Additionally, the primary blades 31, 32, and 37 and secondary blades 33-36 in example embodiments may be substantially straight as they extend towards full gage diameter or may curve along their radial length. Bit 10 further includes a plurality of first cutter elements 101 and a plurality of second cutter elements 102. Preferably, the cutter elements, in particular the one or more first cutter elements, of these embodiments may be positioned on the bit without the use of a retaining element overlayed on at least a portion of the cutter element (cutting face). In this example embodiment, bit 10 has one first cutter element 101 positioned within the cone region 24 as a primary cutter element and a plurality of first cutter elements 101 as primary cutter elements positioned on primary blades 31, 32, 37 and secondary blades 33-36 in the shoulder region 25. Bit 10 contains a plurality of second cutter elements 102 positioned within the shoulder region 25 as backup cutter elements positioned on primary blades 31, 32, and 37 and positioned within the cone region 24 as primary cutter elements positioned on primary blades 31, 32, and 37. In this example embodiment, bit 10 also contains a plurality of first cutter elements 101 in the gage region 26 positioned on the primary blades 31, 32 and 37 and well as secondary blades 33, 34, 35, and 36 as primary cutter elements. In this example embodiment, bit 10 also contains a plurality of second cutter elements 102 in the gage region 26 positioned on primary blades 31, 32 and 37 and secondary blades 33, 34, 35 and 36 as a primary cutter elements (not shown) and as a backup cutter element on primary blades 31, 32 and 37. In other example embodiments, backup cutter elements may be provided on one or more secondary blades.

The cutter element layout of FIG. 9 is a single set layout with the backup cutter elements "off-profile". First cutter element 101 is a cutter element similar to that shown and described in FIG. 6 with a second region 81 extending to about 250 microns from the upper surface 82 which is substantially free of the infiltrant material. The substrate 43 is a sintered tungsten carbide cobalt substrate. First cutter element 101 has a greater impact resistance than cutter element 104, discussed hereinafter, and greater thermal stability than the second cutter element 102. Greater thermal stability can reduce the wear rate of the cutter elements. First cutter element 101 has a similar impact resistance to second cutter element 102. Second cutter element 102 is a standard cutter element containing a sintered tungsten carbide cobalt substrate and a diamond body containing catalyst material in the interstitial regions throughout the diamond body. The diamond body of second cutter element 102 is prepared using two different diamond powders to provide a gradient in the diamond body. In this arrangement, there is a first cutter element 101 located in the cone region on the leading primary blade because there may be more wear in this area in the cone region. Also, the second cutter element 102 is positioned in the gage region in the areas where less load and wear may be experienced. The first cutter elements 101 are also positioned on the primary and secondary blades in the shoulder region to provide enhance thermal stability. Generally, the shoulder region experiences greater thermal wear and/or mechanical wear than the cone and gage regions.

Figure 10:
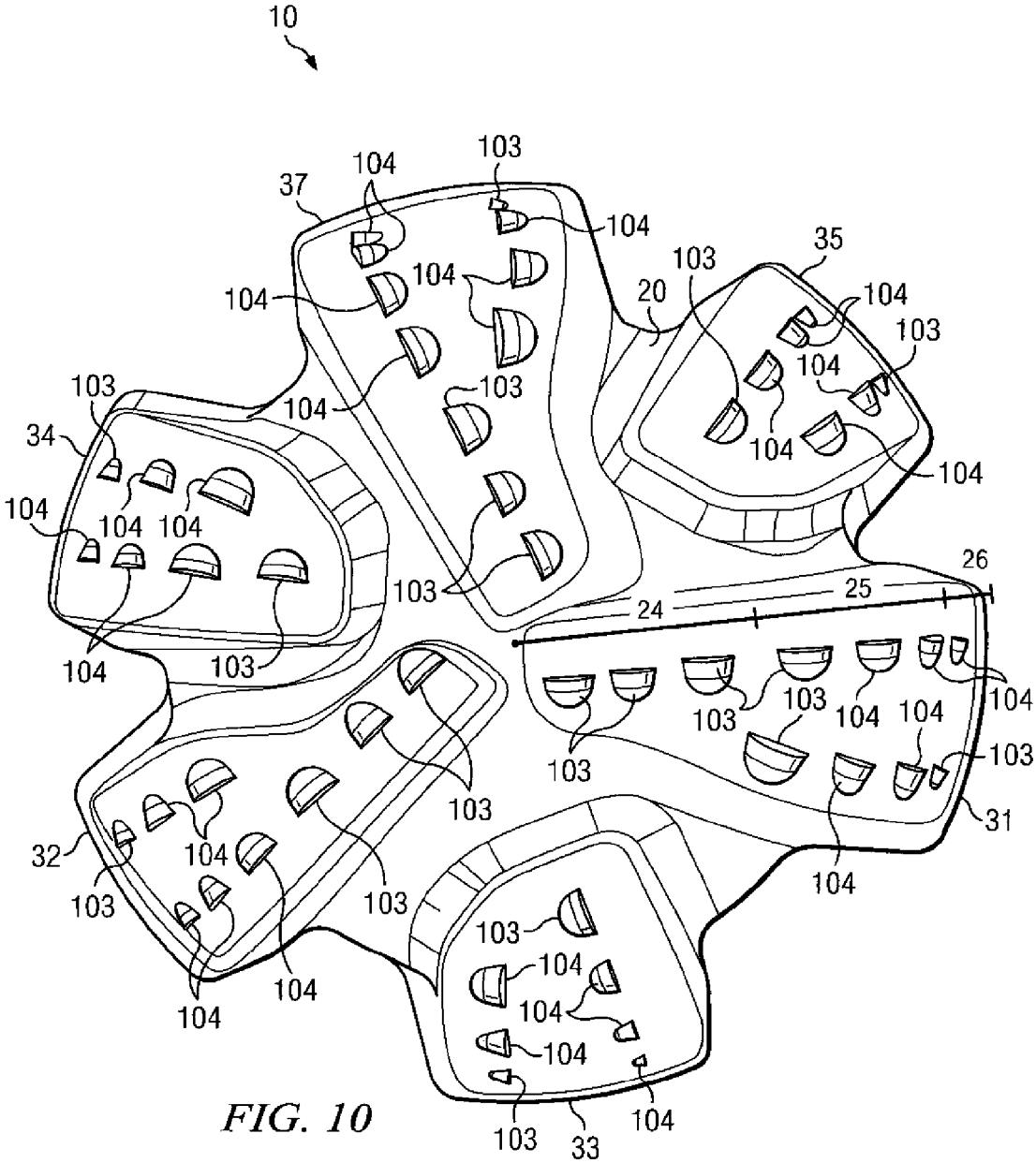
FIG. 10 is a schematic top view of a bit made in accordance with the principles described herein.

FIG. 10 is a schematic top view of a bit made in accordance with the principles described herein. As discussed above, bit 10 may comprise a bit face 20 having a cone region 24, a shoulder region 25, and a gage region 26. In this example embodiment, bit 10 has primary blades 31, 32, and 37 and secondary blades 33-35. Bit 10 further includes a plurality of first cutter elements 104 and a plurality of second cutter elements 103. In this example embodiment, bit 10 has a plurality of first cutter elements 104 as primary and backup cutter elements positioned on the primary blades 31, 32, 37 and secondary blades 33-35 in the shoulder region 25. Bit 10 contains a plurality of second cutter elements 103 positioned within the cone region 24 as primary cutter elements and in the shoulder region 25 as primary and backup cutter elements positioned on the primary blades 31, 32, and 37 and the secondary blades 33, 34, and 35. In this example embodiment, bit 10 also contains a plurality of first cutter elements 104 in the gage region 26 positioned on the primary blades 31, 32 and 37 as primary cutter elements as well as on secondary blades 33, 34, and 35 as primary cutter elements. In this example embodiment, bit 10 also contains a plurality of second cutter elements 103 in the gage region 26 positioned on the primary blades 31, 32 and 37 as the last primary cutter element (not shown) and the last two backup cutter elements (the last of which is not shown). Bit 10 also contains a plurality of second cutter elements 103 in the gage region 26 positioned on secondary blades 33, 34, and 35 as the last primary cutter element (not shown) and the last two backup cutter elements (the last of which is not shown).

The cutter element layout is a single set layout for the primary cutter elements with some of the backup cutter elements being single set (at a unique radial and/or axial position) and some being plural set. The backup cutter elements are "off-profile". First cutter element 104 is a cutter element similar to first cutter element 101 but having a greater wear resistance and less impact resistance than first cutter element 101. First cutter element 104 has greater thermal stability and slightly less impact resistance than the second cutter element 103. Second cutter element 103 is a standard cutter element which additionally has a first region comprising the catalyst material disposed within the interstitial regions and remote from the surface and a second region extending to a depth of up to 0.1 mm which comprises interstitial regions that are substantially free of the catalyst material. Second cutter element 103 also contains a sintered tungsten carbide cobalt substrate. The diamond body of second cutter element 103 is prepared using two different diamond powders to provide a gradient in the diamond body. This cutter element arrangement is one that provides a cost effective bit (first cutter elements are generally more expensive to manufacture) by positioning the first cutter element 104 in areas of the bit (e.g., the shoulder region as primary and backup cutter elements and gage region as primary cutter elements) which benefit more from the properties of the first cutter element 104.

Figure 11:
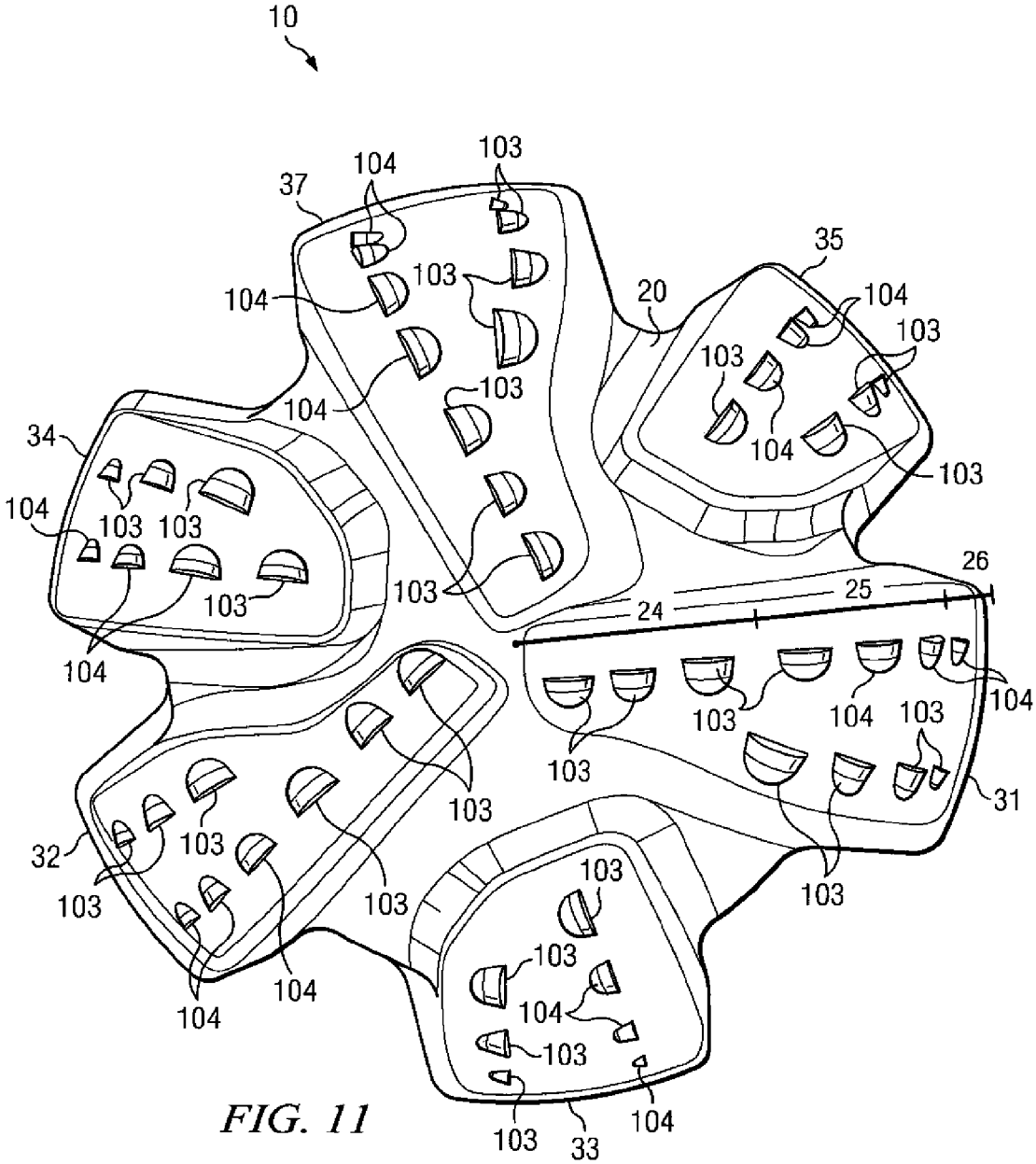
FIG. 11 is a schematic top view of a bit made in accordance with the principles described herein.

FIG. 11 is a schematic top view of a bit made in accordance with the principles described herein. FIG. 11 is similar to FIG. 10 except the backup cutter elements in the shoulder region 25 on primary blades 31, 32, and 37 and on secondary blades 33, 34, and 35 are second cutter elements 103 and are "on-profile" performing active cutting. This cutter element arrangement is one that provides a most cost effective bit by positioning the first cutter element 104 in areas of the bit (e.g., the shoulder and gage regions as primary cutter elements) which benefit most from the properties of the first cutter element 104.

Generally, a standard cutter element which contains catalyst material in the interstitial regions throughout the diamond body is the most cost effective to manufacture as there are no processing steps to remove catalyst and/or infiltrant material. Such standard cutter elements have the lowest thermal stability, see Table 1 below. A standard cutter element having a first region comprising catalyst material disposed within the interstitial regions and remote from the surface and a second region comprising interstitial regions substantially free of the catalyst material is not as cost effective to manufacture as there are more processing steps than with a standard cutter element having the catalyst material disposed within the interstitial regions throughout the diamond body. Further, as the depth of the second region which is substantially free of catalyst material increases, the thermal stability also tends to increase but so does the cost of manufacture as more processing time and/or more rigorous processing conditions are necessary to remove the catalyst material to a greater depth. However, the thermal stability of such cutter elements is greater than standard cutter elements having catalyst material throughout the diamond body, see Table 1 below. The first cutter element is generally most expensive to manufacture in comparison as two or more HPHT processes are typically required as well as one removal process to render the interstitial regions throughout the diamond body substantially free of the catalyst material used to form the diamond body and one removal process to provide a region substantially free of an infiltrant material. However, the thermal stability of such a first cutter element is generally greater than other cutter elements, see Table 1 below. Thus, by positioning the first cutter elements in areas which benefit most from the properties of the first cutter element (e.g., thermal stability, wear resistance, etc.), an economical bit can be obtained which performs similar to or better than other bits not made according to the present disclosure.

For illustrative purposes, a standard cutter element, Cutter Element A, containing a sintered tungsten carbide cobalt substrate and a diamond body containing catalyst material (cobalt used to form the diamond body) in the interstitial regions substantially throughout the diamond body was tested for milling impact wear resistance. The method for measuring milling impact involved mounting a 0.630 inch (16 mm) diameter cutter element to a fly cutter for machining a face of a block of Barre granite. The fly cutter rotated about an axis perpendicular to the face of the granite block and traveled along the length of the block so as to make a scarfing cut in one portion of the revolution of the fly cutter. In particular, the fly cutter was rotated at 3400 rpm. The travel of the fly cutter along the length of the scarfing cut was at a rate of 5 inches per minute (12.7 centimeters/min). The depth of the cut, i.e., the depth perpendicular to the direction of travel, is 0.10 inch (2.5 mm). The cutting path, i.e., offset of the cutting disk from the axis of the fly cutter is 0.75 inch (19.1 mm). The cutter element has a back rake angle of 10°. A determination was made of how many inches (millimeters) of the granite block was cut prior to failure of the cutter element. The result for Cutter Element A is provided below in Table 1. Cutter Element B was also tested for milling impact wear resistance. Cutter Element B was a standard cutter element which had a first region comprising the cobalt catalyst material disposed within the interstitial regions and remote from the surface and a second region extending to a depth of up to about 0.1 mm from the surface comprising interstitial regions that were substantially free of the cobalt catalyst material used to form the diamond body. Cutter Element B also contained a sintered tungsten carbide cobalt substrate. The result for Cutter Element B is provided below in Table 1. Cutter Element C was also tested for milling impact wear resistance. Cutter Element C was a cutter element having a diamond body containing interstitial regions that were substantially free of the cobalt catalyst material used to form the diamond body and having a first region containing a cobalt infiltrant material disposed within the interstitial regions and remote from the surface and a second region containing interstitial regions that are substantially free of the cobalt infiltrant material extending up to a depth of about 0.25 mm from the surface, similar to FIG. 6. Cutter Element C also contained a sintered tungsten carbide cobalt substrate. The result for Cutter Element C is provided below in Table 1.

TABLE 1

| Cutter Element | Length Milled Prior to Failure (inches) [cm] |
|---|---|
| A | (22.5) [57.1] |
| B | (145) [368.3] |
| C | (265) [673.1] |

Figure 12:
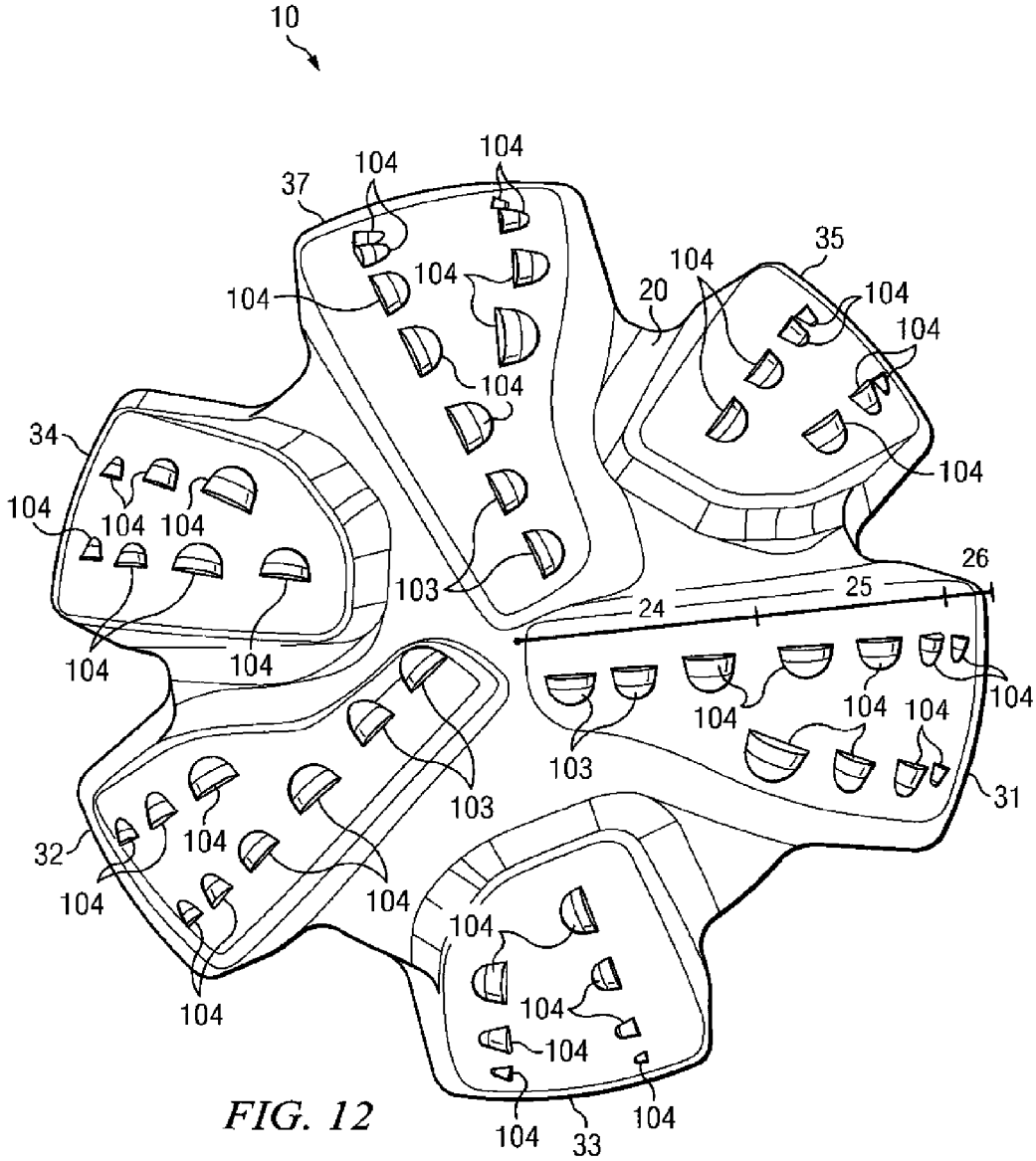
FIG. 12 is a schematic top view of a bit made in accordance with the principles described herein.

FIG. 12 is a schematic top view of a bit made in accordance with the principles described herein. As discussed above, bit 10 may comprise a bit face 20 having a cone region 24, a shoulder region 25, and a gage region 26. In this example embodiment, bit 10 has primary blades 31, 32, and 37 and secondary blades 33-35. Bit 10 further includes a plurality of first cutter elements 104 and a plurality of second cutter elements 103. In this example embodiment, bit 10 has a plurality of first cutter elements 104 as primary cutter elements positioned on the primary blades 31, 32, 37 and secondary blades 33-35 in the shoulder region 25. Bit 10 has a plurality of first cutter elements 104 as backup cutter elements positioned on the primary blades 31, 32, 37 and secondary blades 33-35 in the shoulder region 25. Bit 10 contains a plurality of second cutter elements 103 positioned within the cone region 24 as primary cutter elements positioned on the primary blades 31, 32, and 37. In this example embodiment, bit 10 also contains a plurality of first cutter elements 104 in the gage region 26 positioned on the primary blades 31, 32 and 37 as primary and backup cutter elements (the last backup cutter element is not shown) as well as on secondary blades 33, 34, and 35 as primary and backup cutter elements (the last of both the primary and backup cutter elements are not shown). In this example embodiment, bit 10 also contains a plurality of second cutter elements 103 in the gage region 26 positioned on the primary blades 31, 32 and 37 as the last primary cutter element (not shown). This cutter element layout is a single set layout for the primary cutter elements with some of the backup cutter elements being single set and some being plural set. The backup cutter elements are "off-profile". In this arrangement, there is a first cutter element 104 located in the cone region on the leading primary blade because there may be more wear in this area in the cone region. Also, a second cutter element 103 is positioned in the gage region as the last primary cutter element on the primary blades (not shown) where less load and wear may be experienced.

Figure 13:
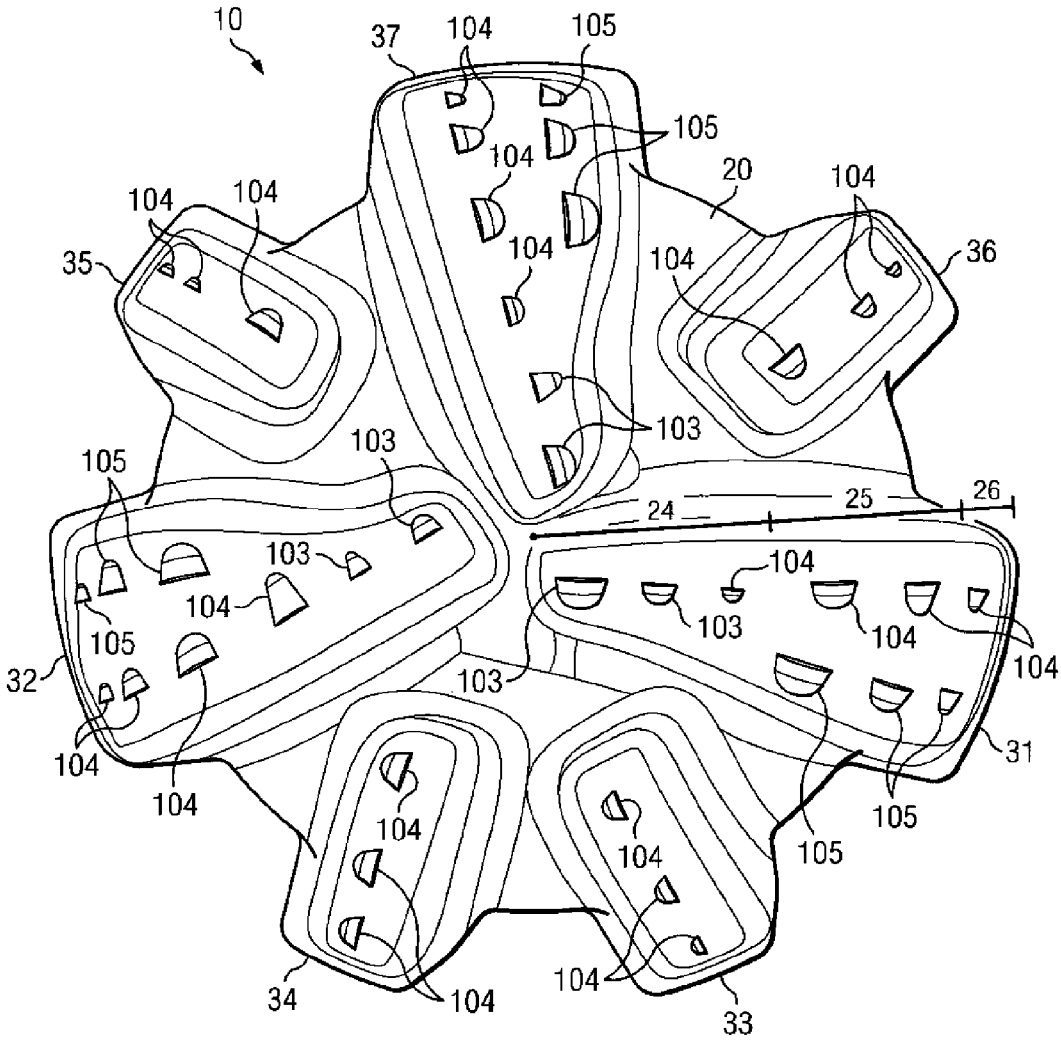
FIG. 13 is a schematic top view of a bit made in accordance with the principles described herein.

FIG. 13 is a schematic top view of a bit made in accordance with the principles described herein. As discussed above, bit 10 may comprise a bit face 20 having a cone region 24, a shoulder region 25, and a gage region 26. In this example embodiment, bit 10 has primary blades 31, 32, and 37 and secondary blades 33-36. Bit 10 further includes a plurality of first cutter elements 104 and a plurality of second cutter elements 103. In this example embodiment, bit 10 has a plurality of second cutter elements 103 positioned within the cone region 24 as primary cutter elements on primary blades 31, 32 and 37. In this embodiment, bit 10 has one first cutter element 104 positioned within the cone region 24 as a primary cutter element. Bit 10 has a plurality of first cutter elements 104 positioned as primary cutter elements on primary blades 31, 32, 37 and secondary blades 33-36 in the shoulder region 25. Bit 10 contains a plurality of second cutter elements 103 positioned within the gage region 26 as the last primary cutter elements positioned on primary blades 31, 32, and 37 and secondary blades 33-36 (not shown). In this example embodiment, bit 10 also contains a plurality of third cutter elements 105 in the shoulder region 25 positioned on the primary blades 31, 32 and 37 as backup cutter elements. In this example embodiment, bit 10 also contains a plurality of first cutter elements 104 in the gage region 26 positioned on the primary blades 31, 32 and 37 as primary cutter elements as well as on secondary blades 33, 34, and 35 as primary cutter elements. In this example embodiment, bit 10 also contains a plurality of third cutter elements 105 in the gage region 26 positioned on primary blades 31, 32 and 37 as the last backup cutter element.

The cutter element layout is a single set layout for the primary cutter elements with some of the backup cutters being single set and some being plural set. The backup cutters are "off-profile". Third cutter element 105 is a standard cutter element which additionally has a first region comprising the catalyst material disposed within the interstitial regions and remote from the surface and a second region extending to a depth of up to 0.1 mm which comprises interstitial regions that are substantially free of the catalyst material. Third cutter element 105 also contains a sintered tungsten carbide cobalt substrate. The third cutter element 105 has a greater impact resistance than first cutter element 104 and less impact resistance than second cutter element 103 and less wear resistance and thermal stability than first cutter element 104 and greater wear resistance and thermal stability than second cutter element 103. This cutter element arrangement is one that provides a cost effective bit by positioning the first cutter element 104 in areas of the bit (e.g., the shoulder and gage regions as primary cutter elements) which benefit most from the properties of the first cutter element 104.

In one or more embodiments, substantially all the primary cutter elements in the shoulder region on the secondary blades may be the first cutter element. In one or more embodiments, the shoulder region of a primary blade may contain substantially all first cutter elements, and on the same blade, at least one second cutter element may be positioned within the cone region and optionally the gage region. In this example embodiment, suitably more than one of the primary blades contains this example arrangement.

In an example embodiment, the BHA may also comprise a hole opener or reaming section. The reaming section may also comprise one or more cutter elements. Depending on the properties of the BHA, the cutter elements arranged in the reaming section may comprise a first cutter element, a second cutter element, a third cutter element, or combinations thereof. Suitably, at least one second cutter element may be placed in the up-reaming region of the reaming section and at least one first cutter element may be placed on the bit portion.

While specific embodiments have been shown and described, modifications thereof may be made by one skilled in the art without departing from the scope or teaching herein. The embodiments described herein are exemplary only and are not limiting. For example, embodiments described herein may be applied to any bit layout including without limitation single set bit designs where each cutter element has a unique radial and/or axial position along the rotated cutting profile, plural set bit designs where each cutter element does not have a unique position (e.g., a cutter element in the same radial position provided on the same or a different blade when viewed in rotated profile), forward spiral bit designs, reverse spiral bit designs, or combinations thereof. In addition, embodiments described herein may also be applied to straight blade configurations or helix blade configurations. Many variations and modifications of the BHA, in particular drill bit, are possible. For example, the bit diameter may range from 5⅞" to 16" or larger. For example, in the embodiments described herein, a variety of features including without limitation spacing between cutter elements, cutter element geometry and orientation (e.g., back rake, side rake, etc.), size of the cutter element (e.g., cutter element diameters ranging from 9 mm to 22 mm, such as 9, 11, 13, 16, 19, 22 mm) cutter element locations, and cutter element extension heights may be varied which can affect one or more properties of the BHA/drill bit. Once the one or properties of the BHA, in particular drill bit, have been determined, the placement for the plurality of cutter elements may be determined based on the one or more different properties of the at least two different cutter elements and the one or more BHA/bit properties. Utilizing two or more different cutter elements and selecting the optimum cutter element placement for each area of a drill bit or bottom hole assembly can maximize performance as well as reduce cost.

What is claimed is:

1. A method of designing a bottom hole assembly comprising a drill bit having a bit body and a plurality of cutter elements attached thereto, which method comprises:

selecting a design;

determining at least one or more properties of the drill bit; and determining an arrangement for the plurality of cutter elements to be positioned upon the bit body;

wherein the plurality of cutter elements comprise at least one of a first cutter element and at least one of a second cutter element;

wherein the first cutter element is a thermally stable polycrystalline diamond cutter element containing a diamond body having a material microstructure comprising a matrix phase of bonded together diamond crystals formed at high pressure/high temperature conditions in the presence of a catalyst material, the diamond body having a working surface for contacting an earthen formation and including interstitial regions disposed between the diamond crystals, wherein the interstitial regions within the diamond body are substantially free of the catalyst material and the diamond body further comprises:

a first region comprising an infiltrant material disposed within a first plurality of the interstitial regions and remote from the working surface, and a second region extending to the working surface and comprising a second plurality of the interstitial regions that are substantially free of the infiltrant material; and wherein one or more areas of the drill bit have different properties relative to other areas of the drill bit;

wherein the second cutter element comprises a polycrystalline ultra hard material and differs from the first cutter element in at least one cutter element property; and wherein the at least one first cutter element and the at least one second cutter element are positioned on the surface of the bit body based on the one or more drill bit properties and the cutter element properties.

2. The method of claim 1, wherein the one or more properties of the drill bit are selected from the group consisting of impact force, drilling load, and wear rate.

3. The method of claim 1, wherein the one or more cutter element properties are selected from the group consisting of wear resistance, impact resistance, thermal stability, coefficient of friction, hardness, fracture resistance, corrosion resistance, erosion resistance, and cutter element geometry.

4. The method of claim 1, wherein the second cutter element contains a second diamond body having a material microstructure comprising a matrix phase of bonded together diamond crystals formed at high pressure/high temperature conditions in the presence of a catalyst material, the second diamond body having a surface and including interstitial regions disposed between the diamond crystals, wherein the catalyst material is disposed within the interstitial regions throughout the diamond body.

5. The method of claim 1, wherein the second cutter element contains a second diamond body having a material microstructure comprising a matrix phase of bonded together diamond crystals formed at high pressure/high temperature conditions in the presence of a catalyst material, the second diamond body having a surface and including interstitial regions disposed between the diamond crystals, wherein the second diamond body comprises:

a first region comprising the catalyst material disposed within the interstitial regions remote from the surface, and a second region comprising interstitial regions that are substantially free of the catalyst material.

6. The method of claim 5, wherein the second diamond body second region extends to a depth of up to 0.25 mm from the second diamond body surface of the diamond body.

7. The method of claim 1, wherein the second cutter element contains a second diamond body having a material microstructure comprising a matrix phase of bonded together diamond crystals formed at high pressure/high temperature conditions in the presence of a catalyst material, the second diamond body having a surface and including interstitial regions disposed between the diamond crystals which contain infiltrant material and/or replacement material and are substantially free of the catalyst material.

8. The method of claim 1, wherein the second cutter element contains a second diamond body having a material microstructure comprising a matrix phase of bonded together diamond crystals formed at high pressure/high temperature conditions in the presence of a catalyst material, the second diamond body having a surface and including interstitial regions disposed between the diamond crystals which are substantially free of the catalyst material and the second diamond body comprises:

a first region comprising an infiltrant material disposed within the interstitial regions and remote from the surface; and a second region comprising a replacement material disposed within the interstitial regions.

9. The method of claim 1, wherein the at least one second cutter element is a thermally stable polycrystalline diamond cutter element containing a second diamond body having a material microstructure comprising a matrix phase of bonded together diamond crystals formed at high pressure/high temperature conditions in the presence of a catalyst material, the second diamond body having a surface and including interstitial regions disposed between the diamond crystals, wherein the interstitial regions within the second diamond body are substantially free of the catalyst material and the second diamond body comprises:

a first region comprising an infiltrant material or replacement material disposed within the interstitial regions and remote from the surface, and a second region comprising interstitial regions that are substantially free of the infiltrant material and replacement material.

10. The method of claim 9, wherein the at least one first cutter element has a greater thermal stability and substantially the same impact resistance as the second cutter element and the first cutter element and the second cutter element have different compositions.

11. The method of claim 9, wherein the at least one first cutter element has a greater thermal stability than the second cutter element.

12. The method of claim 1, wherein the bit body has a bit face comprising a cone region, a shoulder region, and a gage region, wherein the at least one first cutter element is positioned within the shoulder region and the at least one second cutter element is positioned within the cone region.

13. The method of claim 12, wherein the at least one second cutter element is positioned behind the at least one first cutter element on a blade in the shoulder region.

14. The method of claim 1, wherein the bit body has a bit face comprising a cone region, a shoulder region, and a gage region, wherein at least one first cutter element is positioned within the cone region and at least one second cutter element is positioned within the cone region, wherein the at least one first cutter element in the cone region is positioned on a leading blade.

15. The method of claim 1, wherein the bit body has a bit face comprising a cone region, a shoulder region, and a gage region, wherein at least one first cutter element is positioned within the shoulder region and at least one second cutter element is positioned within the cone region, shoulder region, or gage region.

16. The method of claim 1, wherein the bottom hole assembly further comprises a reaming section and at least one second cutter element positioned on the reaming section.

17. A bottom hole assembly designed by the method of claim 1.

18. A drill bit for drilling a borehole in earthen formations, the drill bit comprising:

a bit body having a bit axis and a bit face including a cone region, a shoulder region, and a gage region;

one or more primary blades extending radially along the bit face from the cone region through the shoulder region to the gage region;

a plurality of primary cutter elements mounted to one or more of the primary blades in the shoulder region which comprise a first cutter element;

a plurality of primary cutter elements mounted to one or more of the primary blades in the cone region which comprise a second cutter element;

wherein the first cutter element is a thermally stable polycrystalline diamond cutter element containing a diamond body having a material microstructure comprising a matrix phase of bonded together diamond crystals formed at high pressure/high temperature conditions in the presence of a catalyst material, the diamond body having a working surface for contacting an earthen formation and including interstitial regions disposed between the diamond crystals, wherein the interstitial regions within the diamond body are substantially free of the catalyst material and the diamond body comprises:

a first region comprising an infiltrant material disposed within a first plurality of the interstitial regions and remote from the working surface, and a second region extending to the working surface and comprising a second plurality of the interstitial regions that are substantially free of the infiltrant material; and wherein the second cutter element comprises a polycrystalline ultra hard material and differs from the first cutter element in at least one cutter element property.

19. The drill bit of claim 18, wherein the drill bit further comprises one or more secondary blades having primary cutter elements mounted thereon, and wherein a majority of the primary cutter elements in the shoulder region of one or more of the primary blades are first cutter elements.

20. The drill bit of claim 18, wherein the primary cutter elements in the shoulder region of all the primary blades consists essentially of first cutter elements.

21. The drill bit of claim 18, wherein the shoulder region of the primary blades further comprise a plurality of back-up cutter elements mounted to the blades; wherein a majority of the back-up cutter elements comprise the first cutter elements.

22. The drill bit of claim 18, wherein the shoulder region of the primary blades further comprises a plurality of back-up cutter elements mounted to the blades; wherein a majority of the back-up cutter elements comprise the second cutter elements.

23. The drill bit of claim 18, wherein the drill bit further comprises one or more secondary blades having primary cutter elements mounted thereon, and wherein a majority of the primary cutter elements in the shoulder region of one or more of the secondary blades are first cutter elements.

24. The drill bit of claim 23, wherein the shoulder region of the secondary blades further comprise a plurality of back-up cutter elements mounted to the blades; wherein a majority of the back-up cutter elements comprise the first cutter elements.

25. The drill bit of claim 23, wherein the shoulder region of the secondary blades further comprises a plurality of back-up cutter elements mounted to the blades; wherein the majority of the back-up cutter elements comprise the second cutter elements.

26. The drill bit of claim 18, wherein the second cutter element is a thermally stable polycrystalline diamond cutter element containing a second diamond body having a material microstructure comprising a matrix phase of bonded together diamond crystals formed at high pressure/high temperature conditions in the presence of a catalyst material, the second diamond body having a surface and including interstitial regions disposed between the diamond crystals, wherein the second diamond body comprises:

a first region comprising a catalyst material disposed within the interstitial regions and remote from the surface, and a second region comprising interstitial regions that are substantially free of the catalyst material.

27. The drill bit of claim 18, wherein the second cutter element is a polycrystalline diamond cutter element containing a second diamond body having a material microstructure comprising a matrix phase of bonded together diamond crystals formed at high pressure/high temperature conditions in the presence of a catalyst material, the second diamond body having a surface and including interstitial regions disposed between the diamond crystals, wherein the diamond body comprises catalyst material disposed within the interstitial regions throughout the second diamond body.

28. A drill bit for drilling a borehole in earthen formations, the drill bit comprising:

a bit body having a bit axis and a bit face including a cone region, a shoulder region, and a gage region;

one or more primary blades extending radially along the bit face from the cone region through the shoulder region to the gage region;

a plurality of primary cutter elements mounted to one or more of the primary blades in the shoulder region which comprise a first cutter element;

a plurality of primary cutter elements mounted to one or more of the primary blades in the cone region which comprise a second cutter element;

wherein the first cutter element is a thermally stable polycrystalline diamond cutter element containing a diamond body having a material microstructure comprising a matrix phase of bonded together diamond crystals formed at high pressure/high temperature conditions in the presence of a catalyst material, the diamond body having a working surface for contacting an earthen formation and including interstitial regions disposed between the diamond crystals, wherein the interstitial regions within the diamond body are substantially free of the catalyst material and the diamond body comprises:

a first region comprising an infiltrant material disposed within a first plurality of the interstitial regions and remote from the working surface, and a second region extending to the working surface and comprising a second plurality of the interstitial regions that are substantially free of the infiltrant material, wherein the first cutter element has undergone two or more high pressure/high temperature processes; and wherein the second cutter element comprises a polycrystalline ultra hard material and differs from the first cutter element in at least one cutter element property and has undergone only one high pressure/high temperature process to form the second cutter element.

29. A method of designing a drill bit having a bit body and a plurality of cutter elements attached thereto, which method comprises:

selecting a design;

determining at least one or more properties of the drill bit; and determining an arrangement for the plurality of cutter elements to be positioned upon the bit body;

wherein the plurality of cutter elements comprise at least one of a first cutter element and at least one of a second cutter element;

wherein the first cutter element is a thermally stable polycrystalline diamond cutter element containing a diamond body having a material microstructure comprising a matrix phase of bonded together diamond crystals formed at high pressure/high temperature conditions in the presence of a catalyst material, the diamond body having a working surface for contacting and earthen formation and including interstitial regions disposed between the diamond crystals, wherein the interstitial regions within the diamond body are substantially free of the catalyst material and the diamond body further comprises:

a first region comprising an infiltrant material disposed within a first plurality of the interstitial regions and remote from the working surface, and a second region extending to the working surface and comprising a second plurality of the interstitial regions that are substantially free of the infiltrant material; and wherein one or more areas of the drill bit have different properties relative to other areas of the drill bit; wherein the second cutter element comprises a polycrystalline ultra hard material and differs from the first cutter element in at least one cutter element property; and wherein the at least one first cutter element and the at least one second cutter element are positioned on the surface of the bit body based on the one or more drill bit properties and the cutter element properties.

30. A cutter element comprising a diamond body having a material microstructure comprising a matrix phase of bonded together diamond crystals formed at high pressure/high temperature conditions in the presence of a catalyst material, the diamond body having a working surface for contacting an earthen formation and including interstitial regions disposed between the diamond crystals which are substantially free of the catalyst material and the diamond body comprises: a first region comprising an infiltrant material disposed within a first plurality of the interstitial regions and remote from the working surface; and a second region comprising a replacement material disposed within a second plurality of the interstitial regions wherein the second region includes at least a portion of the working surface of the diamond body.

* * * * *